US011761635B2

(12) United States Patent
Gutmark et al.

(10) Patent No.: US 11,761,635 B2
(45) Date of Patent: Sep. 19, 2023

(54) ROTATING DETONATION ENGINES AND RELATED DEVICES AND METHODS

(71) Applicant: University Of Cincinnati, Cincinnati, OH (US)

(72) Inventors: Ephraim J. Gutmark, Cincinnati, OH (US); Vijay G. Anand, Cincinnati, OH (US); Andrew St. George, Cincinnati, OH (US); William Stoddard, Cincinnati, OH (US); Ethan Knight, Mendota Heights, MN (US)

(73) Assignee: University Of Cincinnati, Cincinnati, OH (US)

( * ) Notice: Subject to any disclaimer, the term of this patent is extended or adjusted under 35 U.S.C. 154(b) by 175 days.

(21) Appl. No.: 16/602,433

(22) Filed: Oct. 3, 2019

(65) Prior Publication Data

US 2020/0063968 A1 Feb. 27, 2020

Related U.S. Application Data

(63) Continuation of application No. PCT/US2018/026498, filed on Apr. 6, 2018.
(Continued)

(51) Int. Cl.
*F23R 7/00* (2006.01)

(52) U.S. Cl.
CPC ..... *F23R 7/00* (2013.01)

(58) Field of Classification Search
CPC ..... F23R 7/00; F02C 5/02; F02C 5/10; F02K 7/02; F02K 7/04; F02K 7/10
See application file for complete search history.

(56) References Cited

U.S. PATENT DOCUMENTS 3,240,010 A * 3/1966 Morrison ..... F02K 9/66 60/213
3,355,891 A * 12/1967 Rhodes ..... F02K 7/10 60/768

(Continued)

FOREIGN PATENT DOCUMENTS

EP 2261559 A1 * 12/2010 ..... F23C 99/003

OTHER PUBLICATIONS

Bykovskii et al.; Continuous Spin Detonations; J Propuls Power 2006; 22:1204-16. doi: 10.2514/1.17656.

(Continued)

*Primary Examiner* — Joseph W Sanderson
(74) *Attorney, Agent, or Firm* — Wood Herron & Evans LLP

(57) ABSTRACT

A rotating detonation combustor includes a nozzle coupled to the combustor body at or near the exhaust opening to choke the exhaust opening. A rotating detonation combustor may include a diverting plate positioned radially inward of the inlet annulus and inlet channels for diverting flow of a mixture in an axial direction. A rotating detonation combustor may include a combustor body including an outer shell at least partially defining a detonation combustion chamber and extending axially from a base toward an exhaust opening of the detonation combustion chamber. The base defines a passageway in fluid communication with the detonation combustion chamber and includes an inlet annulus for axially directing a second fluid into the passageway and a plurality of inlet channels for radially directing a third fluid into at least one of the passageway or the detonation combustion chamber, and the detonation combustion chamber is free of any inner body.

9 Claims, 11 Drawing Sheets

Related U.S. Application Data

(60) Provisional application No. 62/650,648, filed on Mar. 30, 2018, provisional application No. 62/482,401, filed on Apr. 6, 2017.

(56) References Cited

U.S. PATENT DOCUMENTS

| | | | | |
|---|---|---|---|---|
| 5,319,935 | A * | 6/1994 | Toon | F23C 6/047 60/737 |
| 5,349,815 | A * | 9/1994 | Kutschenreuter, Jr. | F02K 7/10 60/749 |
| 5,640,851 | A * | 6/1997 | Toon | F23R 3/346 60/737 |
| 6,920,761 | B2 * | 7/2005 | Laper | F23R 7/00 60/773 |
| 6,931,833 | B2 * | 8/2005 | Lupkes | F23R 7/00 60/249 |
| 7,249,721 | B2 * | 7/2007 | Niass | F23D 17/002 239/399 |
| 8,544,280 | B2 * | 10/2013 | Lu | F02K 7/08 431/1 |
| 8,899,010 | B2 * | 12/2014 | Kenyon | F23R 7/00 60/39.38 |
| 9,046,058 | B2 * | 6/2015 | Claflin | F23R 7/00 |
| 9,816,463 | B2 * | 11/2017 | Falempin | F23R 7/00 |
| 10,060,618 | B2 * | 8/2018 | Juan | F23R 7/00 |
| 10,101,033 | B2 * | 10/2018 | Hill | F02K 7/02 |
| 11,149,954 | B2 * | 10/2021 | Tangirala | F23R 3/46 |
| 2004/0128974 | A1 * | 7/2004 | Laper | F02C 5/02 60/39.6 |
| 2006/0260291 | A1 * | 11/2006 | Vandervort | F23C 15/00 60/39.76 |
| 2011/0047962 | A1 * | 3/2011 | Kenyon | F23C 15/00 60/247 |
| 2013/0042595 | A1 * | 2/2013 | Rasheed | F23C 15/00 60/247 |
| 2016/0102609 | A1 * | 4/2016 | Hill | F02C 5/02 431/1 |
| 2017/0146244 | A1 * | 5/2017 | Kurosaka | F23R 3/10 |
| 2018/0179951 | A1 | 6/2018 | Tangirala et al. | |
| 2018/0179952 | A1 | 6/2018 | Peter et al. | |
| 2018/0179953 | A1 | 6/2018 | Tangirala et al. | |
| 2018/0274439 | A1 | 9/2018 | Holley et al. | |
| 2018/0274442 | A1 | 9/2018 | Holley et al. | |
| 2018/0274787 | A1 | 9/2018 | Greene et al. | |
| 2018/0274788 | A1 | 9/2018 | Greene et al. | |
| 2020/0063967 | A1 * | 2/2020 | Leyko | F02K 7/04 |
| 2020/0191398 | A1 * | 6/2020 | Rathay | B64D 27/18 |

OTHER PUBLICATIONS

Bykovskii et al.; Initiation of Detonation in Flows of Fuel—Air Mixtures; Combust Explos Shock Waves 2007; 43:345-54.

Frolov et al.; Large-scale hydrogen-air continuous detonation combustor; Int J Hydrogen Energy 2015; 40:1616-23. doi: 10.1016/j.ijhydene.2014.11.112.

Yao et al.; Numerical Study of the Propulsive Performance of the Hollow Rotating Detonation Engine with a Laval Nozzle; Int J Turbo Jet-Engines 2015; 34:49-54. doi: 10.1515/tjj-2015-0052.

Tang et al.; Three-dimensional numerical investigations of the rotating detonation engine with a hollow combustor; Combust Flame 2015; 162:997-1008. doi: 10.1016/j.combustflame.2014.09.023.

Frolov et al.; Wind tunnel tests of a hydrogen-fueled detonation ramjet model at approach air stream Mach Nos. from 4 to 8; Int J Hydrogen Energy 2017; 42:25401-13. doi: 10.1016/j.ijhydene.2017.08.062.

Bykovskii et al.; Continuous detonation in the regime of self-oscillatory ejection of the oxidizer. 1. Oxygen as a oxidizer; Combust Explos Shock Waves 2010; 46:344-51. doi: 10.1007/s10573-010-0047-z.

Anand et al.; Hollow Rotating Detonation Combustor; 54th AIAA Aerosp. Sci. Meet., San Diego, CA: 2016. doi:10.2514/6.2016-0124.

Anand et al.; Rotating detonation wave mechanics through ethylene-air mixtures in hollow combustors, and implications to high frequency combustion instabilities; Exp Therm Fluid Sci 2018; 92:314-25. published online Dec. 8, 2017, doi: 10.1016/j.expthermflusci.2017.12.004.

Anand et al.; Longitudinal pulsed detonation instability in a rotating detonation combustor; Exp Therm Fluid Sci 2016; 77:212-25. published online Apr. 30, 2016, doi:10.1016/j.expthermflusci.2016.04.025.

Frolov et al.; Hydrogen-fueled detonation ramjet model: Wind tunnel tests at approach air stream Mach No. 5.7 and stagnation temperature 15K; published online Mar. 21, 2018, doi: 10.1016/j.ijhydene.2018.02.187.

Deng et al.; The Feasibility of Mode Control in Rotating Detonation Engine; Appl Therm Eng 2018; 129:1538-50, published online Oct. 28, 2017, doi:10.1016/j.applthermaleng.2017.10.146.

Knight et al.; Effect of corrugated outer wall on operating regimes of rotating detonation combustors; Int. Conf. Jets, Wakes Separated Flows, Oct. 9-12, 2017, Cincinnati, OH: 2017.

Stoddard et al.; Numerical Investigation of Centerbodiless RDE Design Variations; 53rd AIAA Aerosp. Sci. Meet., Kissimmee, Florida, Jan. 5-9, 2015, doi:10.2514/6.2015-0876.

Stoddard et al.; Numerical Investigation of Expanded and Stepped Centerbodiless RDE Designs. 51st AIAA/SAE/ASEE Jt. Propuls. Conf., Orlando, FL: Jul. 27-29, 2015, doi: 10.2514/6.2015-4144.

Stoddard et al.; Experimental Characterization of Centerbodiless RDE Emissions; 55th AIAA Aerosp. Sci. Meet., Grapevine, Texas: 2017, doi:10.2514/6.2017-0788.

Stoddard et al.; Experimental Validation of Expanded Centerbodiless RDE Design, AIAA SciTech Forum, 54th AIAA Aerospace Sciences Meeting, Jan. 4-8, 2016, San Diego, CA, doi: 10.2514/6.2016-0128.

Yao et al.; Numerical study of hollow rotating detonation engine with different fuel injection area ratios; Proc Combust Inst 2016; 000:1-7. published online Sep. 22, 2016, doi:10.1016/j.proci.2016.07.126.

Zhang et al.; Experimental investigations on H2/air rotating detonation wave in the hollow chamber with Laval nozzle; Int J Hydrogen Energy 2017; 42:3363-70. published online Jan. 27, 2017, doi:10.1016/j.ijhydene.2016.12.038.

* cited by examiner

ROTATING DETONATION ENGINES AND RELATED DEVICES AND METHODS

CROSS-REFERENCE TO RELATED APPLICATIONS

This application is a continuation of International Patent Application No. PCT/US18/26498, filed Apr. 6, 2018 (pending), which claims the benefit of U.S. Provisional Application Ser. No. 62/482,401 filed on Apr. 6, 2017, and U.S. Provisional Application Ser. No. 62/650,648 filed on Mar. 30, 2018, the disclosures of which are expressly incorporated by reference herein in their entireties.

TECHNICAL FIELD

The invention relates to rotating detonation engines and, more particularly, to hollow and annular rotating detonation engines and various devices and methods for inducing rotating and/or longitudinal pulsed detonations in a stable manner.

BACKGROUND

This section is intended to introduce the reader to various aspects of art that may be related to various aspects of the present invention, which are described and/or claimed below. This discussion is believed to be helpful in providing the reader with background information to facilitate a better understanding of various aspects of the present invention. Accordingly, it should be understood that these statements are to be read in this light, and not as admissions of prior art.

Detonation is a supersonic combustion mode that produces a pressure gain across the front due to the shock wave linked to the combustion front behind it. This type of combustion can be activated in suitable mixtures in solid, liquid, or gas phase. Rotating detonation combustors or engines (RDCs or RDEs) use detonative combustion which provides stagnation pressure gain in gaseous mixtures and may significantly reduce the fuel consumption of a gas turbine or rocket engine. RDCs have relatively few moving mechanical components and operate at much higher frequencies than pulsed detonation combustors (PDCs). Thus, there may be an opportunity to integrate RDCs into existing gas turbines and rocket engine architectures.

Referring now to FIG. 1A, a conventional RDC 10 includes a combustor body 12 defined by a concentric outer cylindrical shell 14 and hollow base 16 integrally formed together as a unitary piece. Alternatively, the outer cylindrical shell 14 and hollow base 16 may be separately formed as individual pieces and coupled together after formation. An annular combustion chamber 18 is provided between the outer cylindrical shell 14 and a concentric inner cylindrical body 20 such that the inner cylindrical body 20 and outer cylindrical shell 14 define inner and outer surfaces 22, 24 of the combustion chamber 18, respectively. As shown, the outer cylindrical shell 14 extends axially from the hollow base 16 and terminates at or near an exhaust opening 26 of the annular combustion chamber 18. An oxidizer spacer 30 and fuel plate 32, which may be integrally formed together as a unitary piece, are positioned within the hollow base 16 to define an oxidizer plenum 34 and a fuel plenum 36. The inner cylindrical body 20 extends axially from the fuel plate 32 toward the exhaust opening 26. The oxidizer plenum 34 is in fluid communication with the annular combustion chamber 18 via an oxidizer inlet annulus 40 provided between the fuel plate 32 and an upper wall of the hollow base 16, and the fuel plenum 36 is in fluid communication with the annular combustion chamber 18 via a plurality of fuel inlet channels 42 extending axially through the fuel plate 32. In this manner, an oxidizer O such as air may be radially directed into the annular combustion chamber 18 from the oxidizer plenum 34 via the oxidizer inlet annulus 40, and a fuel F such as hydrogen or ethylene may be axially directed into the annular combustion chamber 18 from the fuel plenum 36 via the fuel inlet channels 42.

In operation, as oxidizer O and fuel F enter the annular combustion chamber 18 through the oxidizer inlet annulus 40 and fuel inlet channels 42, respectively, the oxidizer O and fuel F mix together and the mixture M is used to generate rotating detonations within the annular combustion chamber. In this regard, shock from a pre-detonator (not shown) may be injected tangentially into the annular combustion chamber 18 and may initiate a rotating detonation wave for transiting self-sustained detonation waves. Other means of initiating the detonation may be utilized, such as spark plugs or TNT sticks. As shown in FIG. 1B, the rotating detonation wave may propagate in a clockwise propagation direction P, with product expansion E occurring in all three axes downstream of the detonation wave D due at least in part to the directivity of the upstream reactants O, F. However, in most cases, product expansion is essentially two-dimensional due to the relatively small width of the annular combustion chamber 18. In any event, each wave may remain within the combustion chamber 18 at a relatively fixed axial position, such as at or near the oxidizer inlet annulus 40 and/or fuel inlet channels 42, while moving about circumferentially at kilohertz. When a detonation wave consumes reactants O, F, its products expand at supersonic speeds and these products leave the engine via the exhaust opening 26, which may result in generation of thrust.

However, current RDC designs suffer from a variety of instabilities, such as instabilities of the detonation wave, which negatively affect the detonation dynamics within the combustor and which can lead to catastrophic failure of any device implemented downstream of the combustor for power generation. Moreover, annular RDCs incur heat losses due to boundary layer effects from the inner wall, and further suffer from expansion waves formed at the inner wall that weaken the detonation wave. Current RDCs also typically require reactant mixtures having a high threshold reactivity. Current RDCs are also undesirably large. Moreover, current combustors suffer from uncontrolled longitudinal pulsed detonations.

It would therefore be desirable to provide an improved RDC which overcomes these and other drawbacks of prior art RDCs.

SUMMARY OF THE INVENTION

Certain exemplary aspects of the invention are set forth below. It should be understood that these aspects are presented merely to provide the reader with a brief summary of certain forms the invention might take and that these aspects are not intended to limit the scope of the invention. Indeed, the invention may encompass a variety of aspects that may not be explicitly set forth below.

In one embodiment, a combustor includes a combustor body including an outer shell at least partially defining a combustion chamber and extending axially from a hollow base toward an exhaust opening of the combustion chamber. The combustor also includes a nozzle coupled to the combustor body at or near the exhaust opening to choke the exhaust opening. The nozzle may be removably coupled to the combustor body. In addition or alternatively, the nozzle may include a nozzle inlet, a nozzle outlet, and a converging surface between the nozzle inlet and the nozzle outlet. The nozzle may be configured to generate longitudinal pulsed detonations within the combustion chamber. In one embodiment, the combustor further includes an inner body positioned within the outer shell, wherein the inner body at least partially defines the combustion chamber.

In another embodiment, a combustor includes a combustor body including an outer shell at least partially defining a combustion chamber and extending axially from a hollow base toward an exhaust opening of the combustion chamber. The hollow base includes an inlet annulus for radially directing a first fluid into the combustion chamber and a plurality of inlet channels for axially directing a second fluid into the combustion chamber. The combustor also includes a diverting plate positioned radially inward of the inlet annulus and inlet channels for diverting flow of a mixture of the first and second fluids in an axial direction. The diverting plate may be positioned upstream of the combustion chamber. In addition or alternatively, the diverting plate may have a thickness that is within 3 times a width of the inlet annulus. In one embodiment, the hollow base includes a fuel plate and the plurality of inlet channels extend through the fuel plate, and wherein the diverting plate is coupled to the fuel plate. In addition or alternatively, the combustor may further include a nozzle coupled to the combustor body at or near the exhaust opening to choke the exhaust opening, wherein the nozzle is configured to generate longitudinal pulsed detonations within the combustion chamber.

In yet another embodiment, a combustor includes a combustor body including an outer shell at least partially defining a combustion chamber and extending axially from a hollow base toward an exhaust opening of the combustion chamber. The hollow base defines a passageway in fluid communication with the combustion chamber and includes an inlet annulus for axially directing a first fluid into the passageway and a plurality of inlet channels for radially directing a second fluid into at least one of the passageway or combustion chamber, and the combustion chamber is free of any inner body. A backward facing step may be provided between an outer surface of the passageway and an outer surface of the combustion chamber. In one embodiment, the combustion chamber is frustoconical and expands radially outwardly toward the exhaust opening. For example, the combustion chamber may be flared. In one embodiment, the combustor further includes a nozzle coupled to the combustor body at or near the exhaust opening to choke the exhaust opening. For example, the nozzle may include a nozzle inlet, a nozzle outlet, and a converging surface between the nozzle inlet and the nozzle outlet. The nozzle may at least partially define a forward facing step between an outer surface of the combustion chamber and the converging surface of the nozzle. In one embodiment, the combustor further includes at least one ramping surface positioned along an outer periphery of the combustion chamber. In addition or alternatively, the combustor may further include at least one obstruction positioned along an outer periphery of the combustion chamber.

In still another embodiment, a combustor includes a combustor body including an outer shell at least partially defining a combustion chamber and extending axially from a hollow base toward an exhaust opening of the combustion chamber, and at least one obstruction positioned along an outer periphery of the combustion chamber.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1A:
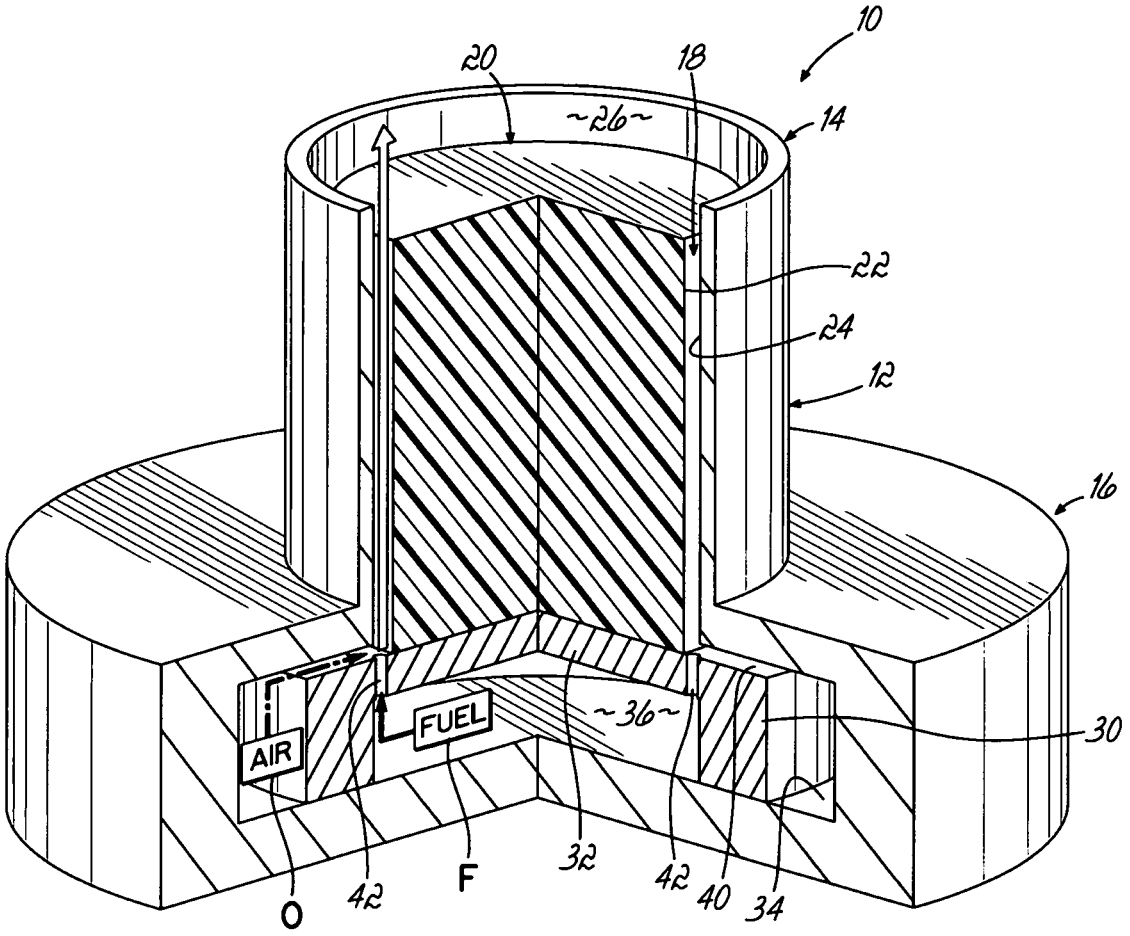
FIG. 1A PRIOR ART
FIG. 1A is a cross sectional view of a prior art RDC.
Figure 1B:
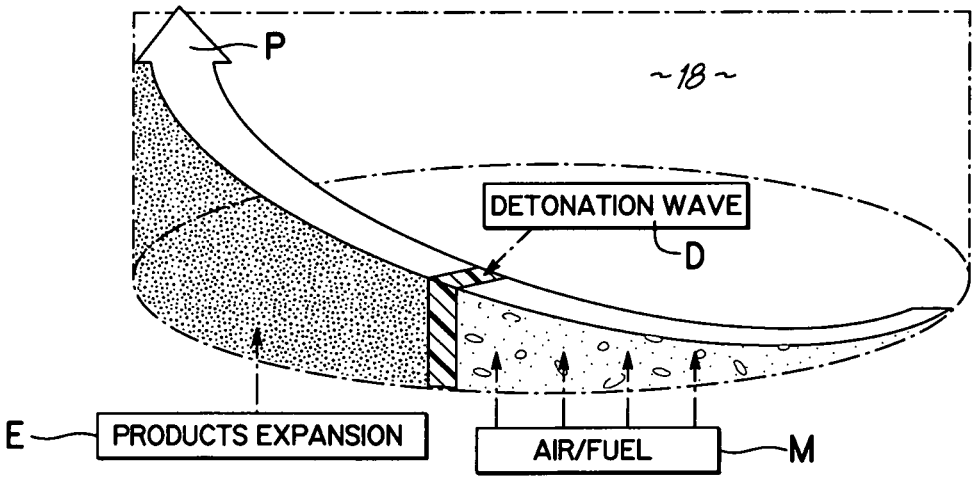
FIG. 1B PRIOR ART
FIG. 1B is a schematic view of a detonation wave propagating in the prior art RDC of FIG. 1A.
Figure 2:
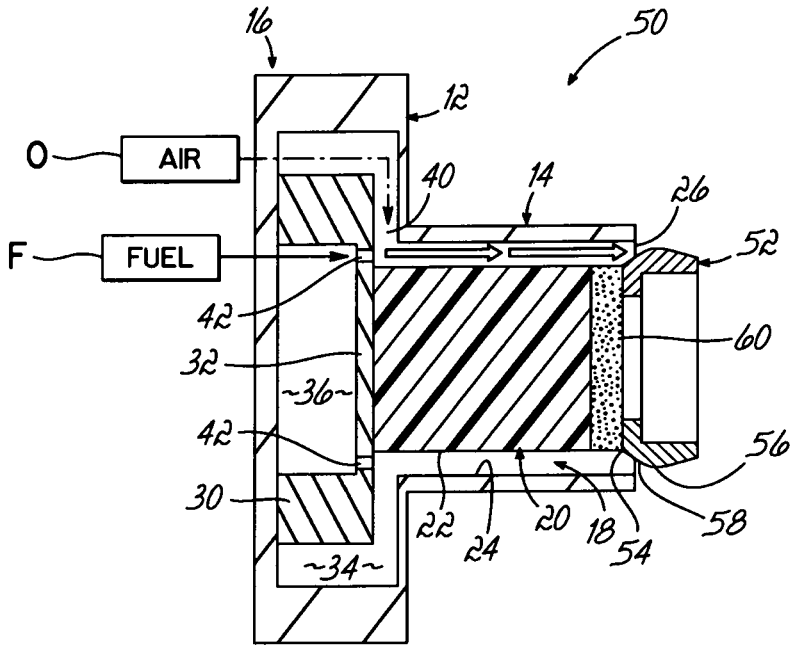
FIG. 2 a cross sectional view of an RDC including a combustor body and a converging nozzle in accordance with an aspect of the invention.

Referring now to FIG. 2, an exemplary rotating detonation combustor or engine (RDC or RDE) 50 is shown in accordance with an aspect of the invention. As discussed in greater detail below, the RDC 50 may eliminate some or all of the instabilities which plague conventional RDCs, and may be suitable for use as pressure gain afterburners, augmenters, and as part of can-annular systems for combustors, among various other applications. In addition or alternatively, the RDC 50 may exhibit enhanced performance, such as by producing rotating detonation waves where they otherwise would not form or sustain, and/or inducing longitudinal pulsed detonations by controlling the pressure ratio. The features of the RDC 50 are set forth in further detail below to clarify each of these functional advantages and other benefits provided in this disclosure.

The illustrated RDC 50 includes a combustor body 12 substantially similar to that of a conventional annular RDC 10. In particular, the combustor body 12 is defined by a concentric outer cylindrical shell 14 and hollow base 16 integrally formed together as a unitary piece. An annular combustion chamber 18 is provided between the outer cylindrical shell 14 and a concentric inner cylindrical body 20 such that the inner cylindrical body 20 and outer cylindrical shell 14 define inner and outer surfaces 22, 24 of the combustion chamber 18, respectively.

As shown, the outer cylindrical shell 14 extends axially from the hollow base 16 and terminates at or near an exhaust opening 26 of the annular combustion chamber 18. An oxidizer spacer 30 and fuel plate 32, which may be integrally formed together as a unitary piece, are positioned within the hollow base 16 to define an oxidizer plenum 34 and a fuel plenum 36. The inner cylindrical body 20 extends axially from the fuel plate 32 toward the exhaust opening 26. The oxidizer plenum 34 is in fluid communication with the annular combustion chamber 18 via an oxidizer inlet annulus 40 provided between the fuel plate 32 and an upper wall of the hollow base 16, and the fuel plenum 36 is in fluid communication with the annular combustion chamber 18 via a plurality of fuel inlet channels 42 extending axially through the fuel plate 32. In this manner, an oxidizer O such as air may be radially directed into the annular combustion chamber 18 from the oxidizer plenum 34 via the oxidizer inlet annulus 40, and a fuel F such as hydrogen or ethylene may be axially directed into the annular combustion chamber 18 from the fuel plenum 36 via the fuel inlet channels 42.

As shown, the RDC 50 also includes a nozzle 52 for assisting in attaining longitudinal self-ignited, self-sustained pulsed detonation inside the combustion chamber 18. In this regard, the nozzle 52 is a converging nozzle removably attached to the combustor body 12 at or near the exhaust opening 26. The converging nozzle 52 includes a nozzle inlet 54, a nozzle outlet 56, and at least one converging surface 58, which is angled or tapered radially outwardly from the nozzle inlet 54 toward the nozzle outlet 56. The converging surface 58 of the nozzle 52 chokes the exhaust opening 26 and thereby backpressurizes both the combustion chamber 18 and oxidizer and fuel plena 34, 36. In the embodiment shown, longitudinal pulsed detonation (LPD) initiation is enabled through shock reflection/focusing from the converging surface 58. Alternatively, backpressurizing the RDC 50 for LPD initiation may be achieved by integrating the RDC 50 with or without the nozzle 52 in an already high-pressure environment, and/or turbine vanes may perform a choking function. In any event, once the LPD is onset, it is sustained continually as long as supply of oxidizer O and fuel F is maintained. In one embodiment, a subsonic air injection combined with a reflected shock wave from a choked exhaust opening 26 with the convergent surface 58 produces a desired reactants plenum recovery time after successive air inlet occlusion to enable sustained longitudinal pulsed detonation. During LPD, every cycle may contain an axisymmetric pulsed detonation near the fuel plate 32, gradually decaying into a detached shock wave which then gets reflected by the converging surface 58 of the nozzle 52 (and/or by a higher pressure fluidic environment) and travels upstream. This may be achieved via a relatively high chamber pressure due to a choked exhaust opening 26 by the converging surface 58 which causes reflected waves moving upstream that eventually detonates a fresh slug of unburnt reactants to cause a detonation that decays into an axially moving shock wave, thereby continuing the cycle. In the embodiment shown, the nozzle 52 is coupled to the inner cylindrical body 20 via at least one nozzle spacer 60. However, the nozzle 52 may be coupled to any suitable portion of the combustor body 12 in any suitable manner.

Figure 3:
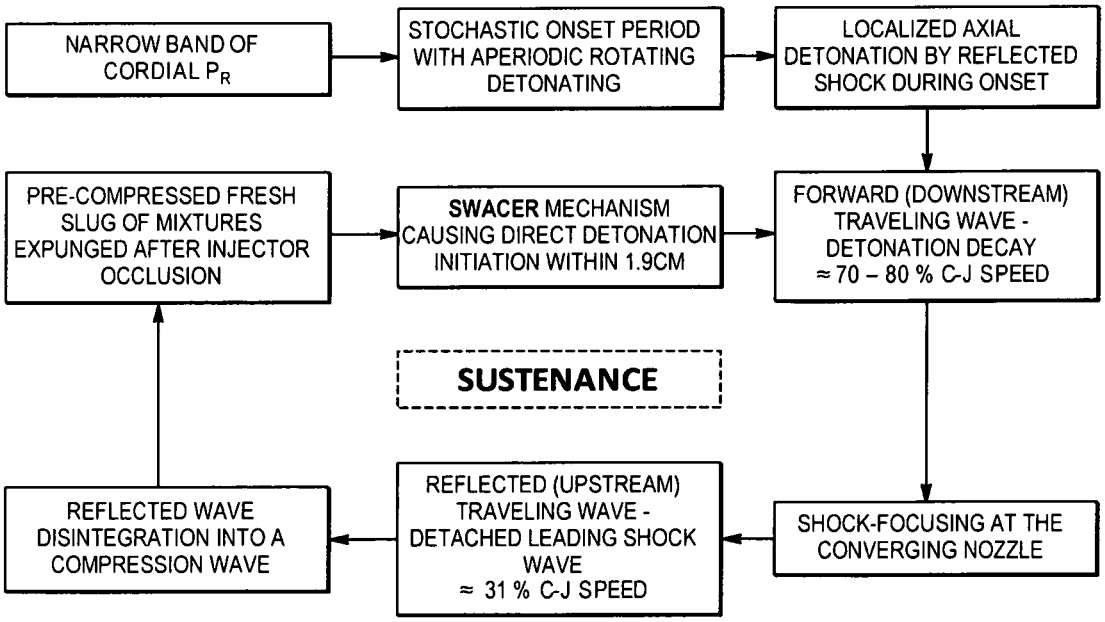
FIG. 3 is a flow chart illustrating sustenance of longitudinal pulsed detonations in the RDC of FIG. 2.

Referring now to FIG. 3, an exemplary mechanism during sustained LPD is shown. Generally, the two most relevant parameters for LPD are the pressure ratio across the injectors and the backpressure on the combustor, typically in that order. At a narrow band of pressure ratio (e.g., 1.4 to 1.85, in the current RDC, but may vary based on the length of the device and the pressure prior to ignition) ignition of the RDC by a blast wave from the pre-detonator (or any other ignition that causes detonation formation) causes an initial explosion. This explosion produces a stochastic onset period prior to stable LPD operation owing to the finite time the supply plenums take to recover to a new steady state after getting disturbed by the initial explosion event. This initial explosion event reflects from the RDC exit end (which is a convergent nozzle in the present embodiment, but may alternatively be a high pressure environment) to cause another major explosion after the initial stochastic onset time. This causes a momentary stoppage of reactants flow by occluding the air and fuel inlets. This secondary explosion after the onset duration travels at 70-80% of the Chapman-Jouguet velocity, axially downstream (this is the ideal model that predicts the ideal wave speed that should be observed in perfect gaseous detonations in most mixtures). It hits the RDC exit boundary (e.g., the nozzle) where the wave gets reflected and focuses back into the upstream direction. During this upstream reflected wave propagation, the speed is only about 30% of the ideal Chapman-Jouguet (C-J) wave speed, suggesting a detached detonation wave (shock wave highly separated from a probable combustion front). When this slower detached wave moves further upstream, it becomes even weaker and becomes a compression wave (a probable acoustic wave). At this same time, the fresh reactants are entering the combustor after the initially occluded injectors relax after the main explosion event. This causes a "stratification" of mixtures, where the fresh reactants can be demarcated axially from the products of the initial explosion. This condition is the requirement for a process called shock wave amplification by coherent energy release (SWACER), which is named as such after LASER. Here, when such a sharp gradient exists in reactivity, and when such a mixture gradient is exposed to a weak compression wave (the weakened reflected wave), it causes a direction detonation ignition, thereby producing the next iteration of the LPD cycle. This method of detonation formation is different from indirect detonation initiation (which is how a pre-detonator/spark plug ignites an RDC) produced by the process of Deflagration-to-Detonation Transition (DDT).

In addition to the illustrated embodiment, any RDC may be configured to attain LPD by backpressurizing the combustion chamber. The combustion chamber may be of any suitable configuration, such as annular or hollow. The pressure ratio (static pressure inside the oxidizer and fuel plena to the static pressure inside the pressurized combustion chamber before ignition) may be responsible for sustaining the LPD process. For example, for the same backpressure, the combustion chamber may not exhibit LPD if the pressure ratio is not conducive. The oxidizer and fuel plena need to recover at just the right time (after every detonation event, which disrupts the plena) so that it provides the proper gradient in reactivity of the mixture. These conditions interact with the compression wave from the backpressurized exhaust opening (which was produced by the initial detonation event, moves downstream, and then subsequently gets reflected upstream from the backpressurized exhaust opening) to produce the next instance of detonation, thereby continuing the whole process, which may be the same as or similar to SWACER (shock wave amplification by coherent energy release).

It will be appreciated that there is a temporal factor to the LPD process which is heavily system dependent. For example, an increase in length of the combustion chamber may result in an increase in time required for the wave to move back and forth, thereby decreasing the frequency of occurrences. To address this issue, the pressure of the plena may be increased so that it recovers faster and increases frequency. In addition or alternatively, the quality of the mixture (e.g., the reactivity) may be a factor in determining the frequency of occurrence of LPD. Thus, all the system-level factors may need to be considered and tuned to attain LPD. The backpressure also affects the frequency of operation of this process.

Figure 4A:
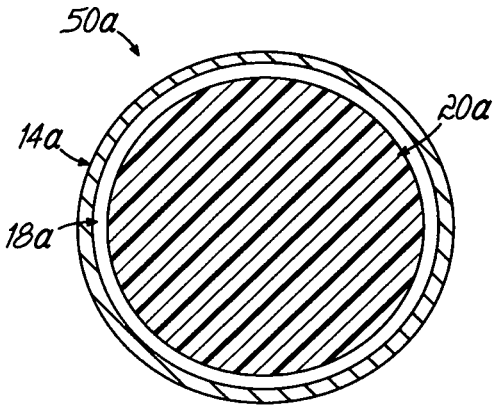
FIGS. 4A-4D are cross sectional views of alternative RDCs.
Figure 4B:
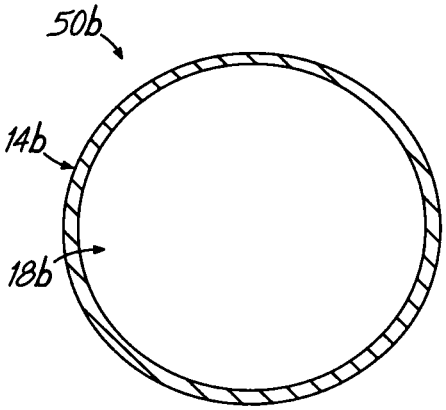
Figure 4C:
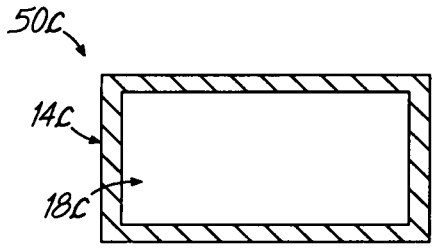
Figure 4D:
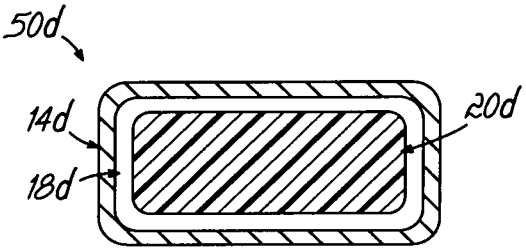

In order to achieve LPD, the cross section of the combustion chamber 18*a*, 18*b*, 18*c*, 18*d* of an RDC 50*a*, 50*b*, 50*c*, 50*d* may be of any suitable shape, such as circular (FIGS. 4A and 4B), oblong, rectangular (FIGS. 4C and 4D), or any other suitable shape. The combustion chamber 18*a*, 18*b*, 18*c*, 18*d* may be defined between an outer shell 14*a*, 14*d* and an inner body 20*a*, 20*d* such that the combustion chamber 18*a*, 18*d* is annular (FIGS. 4A and 4D), or may be defined by an outer shell 14*b*, 14*c* alone such that the combustion chamber 18*b*, 18*c* is hollow (FIGS. 4B and 4C).

Figure 5A:
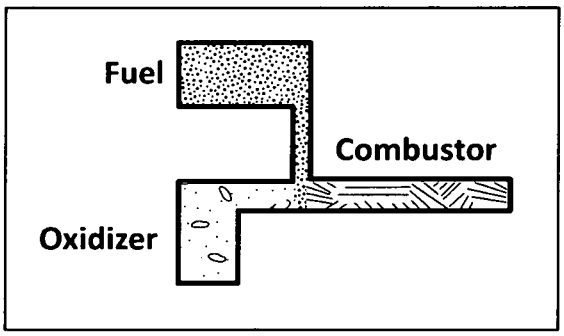
FIGS. 5A and 5B are schematic views of fuel and oxidizer being injected into a combustion chamber in a non-premixed and premixed manner, respectively.
Figure 5B:
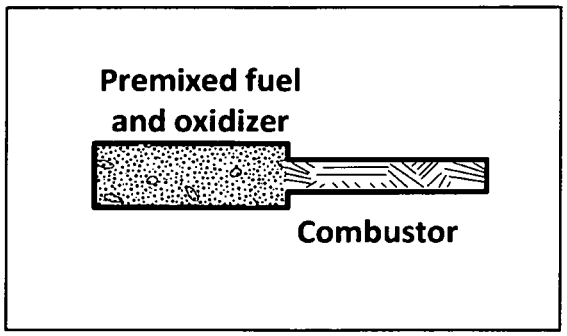
Figure 6A:
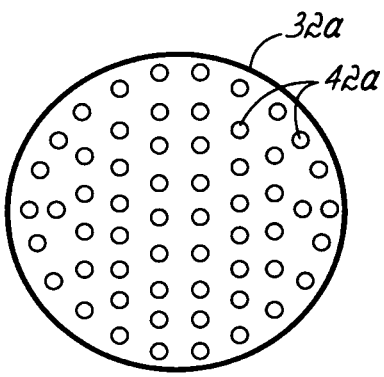
FIGS. 6A-6C are top elevation views of fuel plates of alternative RDCs.
Figure 6B:
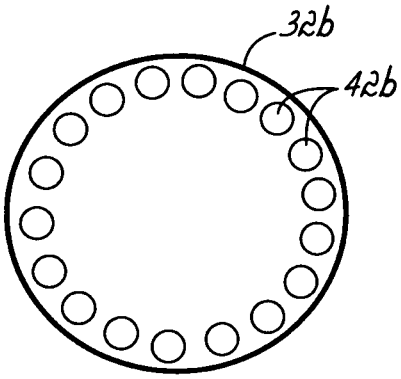
Figure 6C:
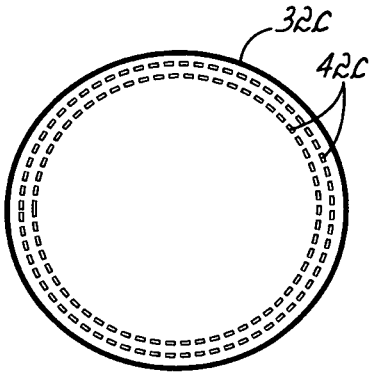
Figure 7A:
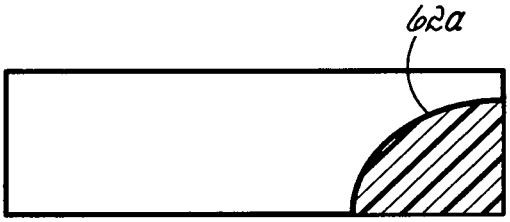
FIGS. 7A-7E are cross sectional views of alternative constrictions.
Figure 7B:
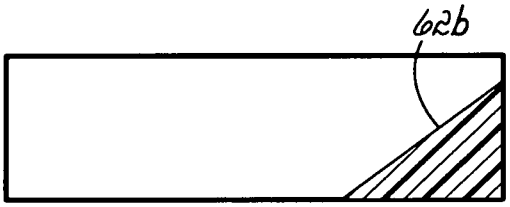
Figure 7C:
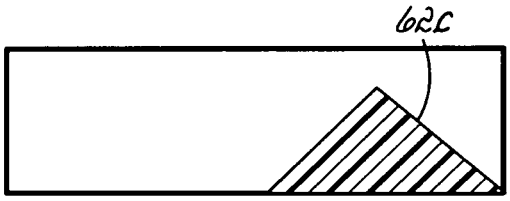
Figure 7D:
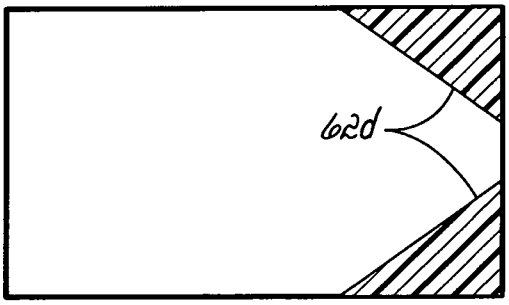
Figure 7E:
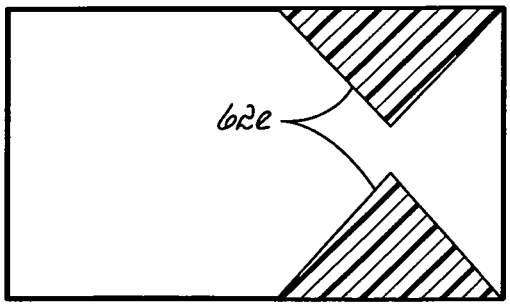

The injection of reactants may be performed with either non-premixed diffusive mixing of the reactants (FIG. 5A), such as in the embodiment shown in FIG. 2, or with premixed reactants (FIG. 5B). Any reactants having suitable detonability characteristics may be used. For example, the fuel may be hydrogen or ethylene, and the oxidizer may be air. Injection of the oxidizer, fuel, and/or mixture thereof may be through orifices and/or slots. For example, injection of the fuel may be through orifices 42*a*, 42*b* (FIGS. 6A and 6B) or slots 42*c* (FIG. 6C) in the fuel plate 32*a*, 32*b*, 32*c*. For attaining rotating detonations in a hollow combustion chamber, such injection may be configured to occur predominantly at or near the periphery of the combustion chamber such that there is a high reactivity mixture for the detonation wave to consume (FIGS. 6B and 6C). Other methods could also be used to have this high reactivity near the outer surface of the combustion chamber, such as using an obstacle to divert the fluid flow toward the outer surface of the combustion chamber (as discussed below), using an injection scheme that diverts the flow toward the outer surface, and/or injecting fuel or oxidizer axially through the outer surface to increase the reactivity locally.

Reactant quality may be at least partially determined by the reactants upstream of the detonation wave being unburnt or fresh. Reactant quality may also be at least partially determined by the equivalence ratio. For example, an equivalence ratio of 1 signifies the proper amount of oxidizer to ensure complete burning of all the reactants, while an equivalence ratio of greater than 1 signifies having more fuel than the oxidizer, resulting in rich and therefore incomplete combustion, and an equivalence ratio of less than 1 signifies more oxidizer than fuel, resulting in lean combustion. Without being bound to any particular theory, an equivalence ratio of at least 0.5 may promote the formation and propagation of detonations in the RDC. It will be appreciated that the higher limit of equivalence ratio may vary depending on the fuel and oxidizer used. For example, H2-air may be incapable of producing detonations when the equivalence ratio is more than 2.54. In other embodiments, the quality, and thus the equivalence ratio, is the one that gives the lowest detonation cell size (easiest quality to attain detonation events). For embodiments utilizing H2-air, the desired equivalence ratio may be 1.0. For ethylene-air, the desired equivalence ratio may be between 1 and 1.1. Thus, the desired equivalence ratio will vary depending on the fuel in the mixture.

The geometry of the combustor body may be configured to facilitate transverse and/or tangential acoustic modes inside for allowing the formation and propagation of rotating detonations therein. For example, the geometry of the combustor body may be similar to that of an annular RDC with the centerbody and/or inner wall assembly removed. The flow rates and reactivity of the reactants may be selected to encourage rotating detonations.

In one embodiment having a longitudinal self-ignited self-sustained pulsed detonation inside a rotating combustor, the back-pressure may be above a specified level, the injection pressure ratio may be between 1.4 and 1.85 (i.e., the ratio of the time-averaged combustor pressure across air inlet and the time-averaged air plenum pressure each before ignition is between 1.4 and 1.85) and the mixture may have a specified reactivity. More specifically, in embodiments of the device having a longitudinal self-ignited self-sustained pulsed detonation, the axial gradient in reactivity of the mixture inside the combustor may be important to ensure the coherent energy release that is required to cause a detonation event, thereby sustaining LPD.

The injection pressure ratio may change if, for instance, the combustor length changes. For example, a higher combustor length may require a higher range of pressure ratio so that the reactants are fed with enough force so as to maintain the same gradient of reactivity as before. Additionally, there should be a similar critical range of pressure ratios for the fuel plenum as well. For non-premixed systems, the pressure ratio across injection of both the reactants may be equally important.

In embodiments of the invention, the reactant flow rate can vary depending on the conditions. In some instances, the reactant flow flux (reactant flow rate/cross-sectional area of the flow passage) may be a better variable than flow rate. Flow rates between 0.2 kg/s-0.5 kg/s have been successfully tested using embodiments described herein. Others have gone up to 7 kg/s. Moving on to full-scale rocket engines, F-1 engines used in the Apollo program probably used significantly higher flow rates, and still were prone to the high frequency tangential instabilities. Hence, the desired flow rate may vary depending on the particular application.

The reactant reactivity, in purely physical terms, can be given as a function of the term Ea (activation energy), which in very simple terms (obtained from statistical thermodynamics) gives the probability a given reactant molecule could collide with another reactant molecule thereby causing a chemical reaction. For low activation energies, detonation wave is stable, whereas for high activation energy detonation wave is unstable. Here, stability refers to the strength of the coupling between the shock wave and the chemical front that together form a detonation wave. Hence, for certain applications the desired reactant reactivity may be such that it has the lowest activation energy possible. It should be noted that a detonation wave can be formed even at higher activation energies, but it may be unstable. To clarify, one could have different activation energies for the same equivalence ratio by altering the temperature and/or pressure.

As previously mentioned, a threshold level of back pressure may be desired to avoid instability. Having no backpressure results in no LPD being produced. However, such a scenario is unlikely for a combustor because it is likely equipped with a turbine (in case of gas-turbine combustors) or a sonic nozzle throat (in case of rocket engine), both of which cause backpressure on the combustor. In this sense, it is very hard to completely remove any backpressure. However, the backpressure is just one part of the larger puzzle for producing LPD. The flow rate, injection pressure ratio and the combustor length also dictate whether or not LPD would occur. As shown and discussed herein, LPD can be avoided if the injection pressure ratio is altered even when the backpressure is maintained constant.

The pressure of the ambient environment (to the combustor) is called backpressure. Thus, one could increase the backpressure by increasing the static ambient pressure. This may cause an increased pressure in the combustor. However, this could also be obtained by using a sonic nozzle and choking the combustor exit flow, as discussed above, thereby once again increasing the static pressure inside the combustor. Back-pressure, being pressure, can be measured through pressure sensors. If the other required parameters are known, it is possible to 'calculate' the back pressure on a system using the usual fluid dynamic flow equations.

It will be appreciated that rotating detonations are capable of being produced when the combustion chamber is backpressurized. However, rotating detonations, unlike LPD, do not require backpressure. Such backpressure can be provided through any suitable geometric constrictions at or near the exhaust opening, which may be incorporated into a nozzle similar to that shown in FIG. 2. Exemplary geometric constrictions 62*a*, 62*b*, 62*c*, 62*d*, 62*e* are illustrated in FIGS. 7A-7E. In addition or alternatively, backpressure may be provided in various other manners, such as by placing the RDC in an artificially pressurized environment, or by adding a turbine at or near the exhaust opening of the RDC.

The length of the combustion chamber may be important for LPD. Moreover, if there is backpressure, then the length of the combustion chamber may be important for rotating detonations as well, since the waves reflected from the backpressurized exhaust opening can potentially interfere with the rotating detonations if the combustion chamber is too short.

It will be appreciated that any combustible reactants may be used to attain rotating detonations and/or LPD. However, some reactants are more detonable than others, and this detonability parameter may be important to account for. For example, hydrogen-air mixtures may sustain rotating detonations better than ethylene-air mixtures in a hollow combustion chamber, even if both mixtures have substantially the same reactivity (e.g., equivalence ratio) at or near the outer surface of the combustion chamber.

Since both rotating detonations and LPD are intrinsically detonation waves, any parameter than enhances detonations in planar one-dimensional detonations can enhance the two processes. For instance, a Shchelkin-type spiral (not shown) can be used inside a hollow combustion chamber to augment the power of rotating detonations.

According to another aspect of the invention, a conventional combustor or rocket engine (not shown) is configured to tune the pressure ratio, backpressure, and reactivity of the mixture so that LPD in hollow combustors does not sustain. This may reduce the occurrence of shock-type longitudinal, back and forth, periodic oscillations, which are typically believed to be highly detrimental to conventional combustors.

Figure 8:
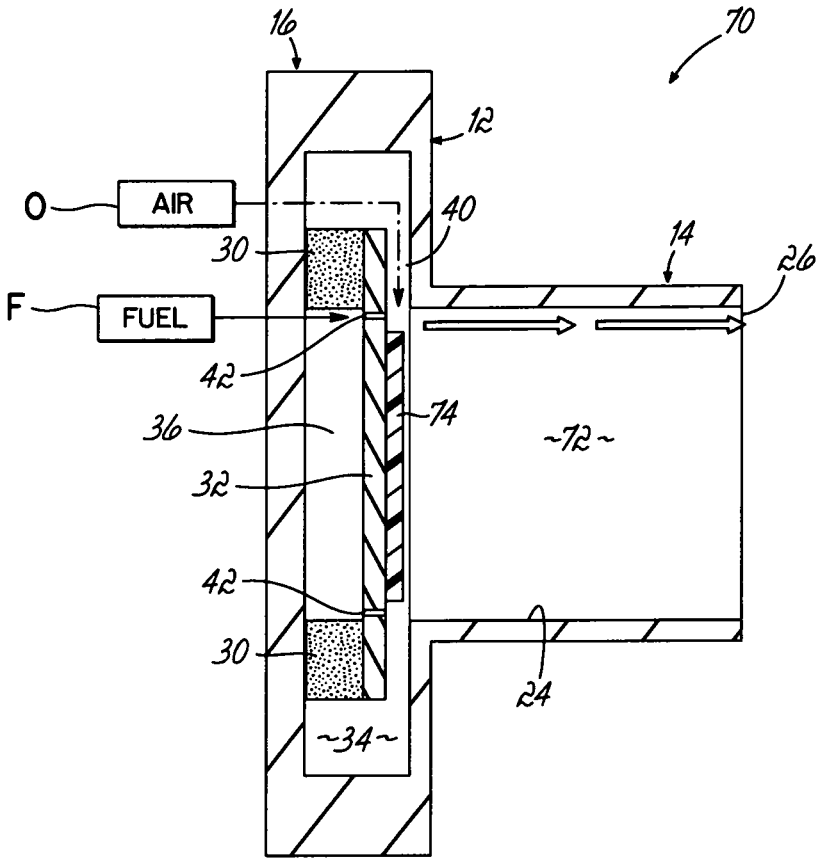
FIG. 8 is a cross sectional view of an RDC including a combustor body and an obstacle or plate in accordance with another aspect of the invention.

Referring now to FIG. 8, an exemplary RDC 70 is shown in accordance with another aspect of the invention. As discussed in greater detail below, the RDC 70 may not be limited by the confines of having a detonation within an annulus, thereby providing lower heat loss and thus a stronger propagating wave such that the detonation wave may sustain and not fail. The RDC 70 may also have beneficial boundary layer effects, since there is only wall to generate a boundary layer capable of disturbing the detonation front. The RDC 70 may also allow the products to expand significantly in all three axes, in contrast to an annular RDC 10, where product expansion is essentially two-dimensional (if the annulus width is relatively small, as in most cases). This highly three-dimensional products expansion of a hollow RDC 70 would enable faster expulsion of products therefrom, which may result in reduced wasteful pre-burning of the fresh mixtures upstream of the detonation wave by the unexited products of the prior lap. This may lead to higher efficiency by allowing the rotating detonation wave to generally only consume purely fresh reactants, since pre-burnt reactants tend to reduce efficiency. The RDC 70 may be suitable for use as pressure gain afterburners, augmenters, and as part of can-annular systems for combustors, among various other applications. The features of the RDC 70 are set forth in further detail below to clarify each of these functional advantages and other benefits provided in this disclosure.

The illustrated RDC 70 includes a combustor body 12 substantially similar to that of a conventional annular RDC 10, but with the inner cylindrical body 20 removed in order to create a hollow structure. In particular, the combustor body 12 is defined by a concentric outer cylindrical shell 14 and hollow base 16 integrally formed together as a unitary piece. A cylindrical combustion chamber 72 is provided within the outer cylindrical shell 14 such that the outer cylindrical shell 14 defines an outer surface 24 of the combustion chamber 72. As shown, the outer cylindrical shell 14 extends axially from the hollow base 16 and terminates at or near an exhaust opening 26 of the combustion chamber 72. An oxidizer spacer 30 and fuel plate 32, which may be integrally formed together as a unitary piece, are positioned within the hollow base 16 to define an oxidizer plenum 34 and a fuel plenum 36. The oxidizer plenum 34 is in fluid communication with the combustion chamber 72 via an oxidizer inlet annulus 40 provided between the fuel plate 32 and an upper wall of the hollow base 16, and the fuel plenum 36 is in fluid communication with the combustion chamber 72 via a plurality of fuel inlet channels 42 extending axially through the fuel plate 32. In this manner, an oxidizer O such as air may be radially directed into the combustion chamber 72 from the oxidizer plenum 34 via the oxidizer inlet annulus 40, and a fuel F such as hydrogen or ethylene may be axially directed into the combustion chamber 72 at or near the outer surface 24 thereof from the fuel plenum 36 via the fuel inlet channels 42. The size of the oxidizer spacer 30 may be selected to determine the oxidizer injection area. In this regard, a greater width of the oxidizer spacer 30 may lower the oxidizer injection area, and vice versa.

As shown, the RDC 70 also includes an obstacle or diverting plate 74 for improving the quality the mixture/reactants at or near the outer surface 24 of the combustion chamber 72 to be conducive to generating rotating detonation. In this regard, the plate 74 has a cross sectional shape similar to that of the combustion chamber 72 and is positioned on the fuel plate 32 of the RDC 70 with the periphery of the plate 74 being radially inward of the fuel inlet channels 42 and oxidizer inlet annulus 40 in order to divert the mixture of the radially inward oxidizer flow and axial fuel flow toward the outer surface 24 of the combustion chamber 72, thereby improving the local mixture quality at the outer surface 24 for achieving sustained rotating detonation. For example, the illustrated plate 74 and combustion chamber 72 each have a generally circular cross sectional shape. The plate 74 may have a thickness substantially less than a height of the combustion chamber 72, and relatively close in magnitude to a width of the oxidizer inlet annulus 40. For example, the thickness of the plate 74 may be within three times the width of the oxidizer inlet annulus 40. In the embodiment shown, the thickness of the plate 74 is less than the width of the oxidizer inlet annulus 40. In one embodiment, the thickness of the plate 74 may be an order of magnitude smaller than the rotating detonation wave height (axially) in an annular RDC 10 having the same reactants and flow rates. For instance, in the annular RDC 10, with the same reactants and flow rates, the rotating detonation wave height may vary between 3 cm to 7 cm, which may be about 10 times greater than the thickness of the plate 74.

In one embodiment, the plate 74 may promote a relatively high equivalence ratio at or near the outer surface 24 and/or a low activation energy of the reactants at or near the outer surface 24.

In one embodiment, the dimensions of the RDC 70 may be as set forth in Table 1.

TABLE 1

Exemplary RDC Dimensions

| Combustor Geometric Parameters | Dimension |
|---|---|
| Combustor diameter | 154 mm |
| Combustor length | 131 mm |
| Air injection slot width | 1 mm |

TABLE 1-continued

Exemplary RDC Dimensions

| Combustor Geometric Parameters | Dimension |
|---|---|
| Length-to-diameter ratio of fuel orifices | 17 |
| Diameter of the outermost row of fuel orifices | 151 mm |
| Diameter of the circular obstacle | 142 mm |
| Thickness of the circular obstacle | 3 mm |

However, it will be appreciated that other dimensions may be used. For example, the dimensions of the RDC 70 may be scalable relative to these exemplary dimensions.

Thus, a hollow combustor body may be converted into a rotating detonation combustor with the addition of an obstacle or plate similar to that shown in FIG. 8. This may enable rotating detonations to be generated in the combustion chamber of such a hollow combustor body by improving reactant quality at or near the outer surface of the combustion chamber.

In one embodiment, an obstacle or plate similar to that shown in FIG. 8 may be incorporated into a hollow RDC having features similar to any of those described above with respect to FIGS. 4B, 4C, 5A, 5B, 6A-6C, and 7A-7E, such as for generating LPD in addition or alternatively to rotating detonations.

According to another aspect of the invention, a conventional combustor (not shown) is configured to reduce the quality of the mixture near the wall(s) of the combustor and avoid setting up transverse and/or tangential acoustic modes. This may reduce the occurrence of high frequency tangential combustion instabilities, or rotating quasi-detonations, which are typically described as having a shock-type characteristic and are commonly believed to be highly detrimental to conventional combustors.

Figure 9:
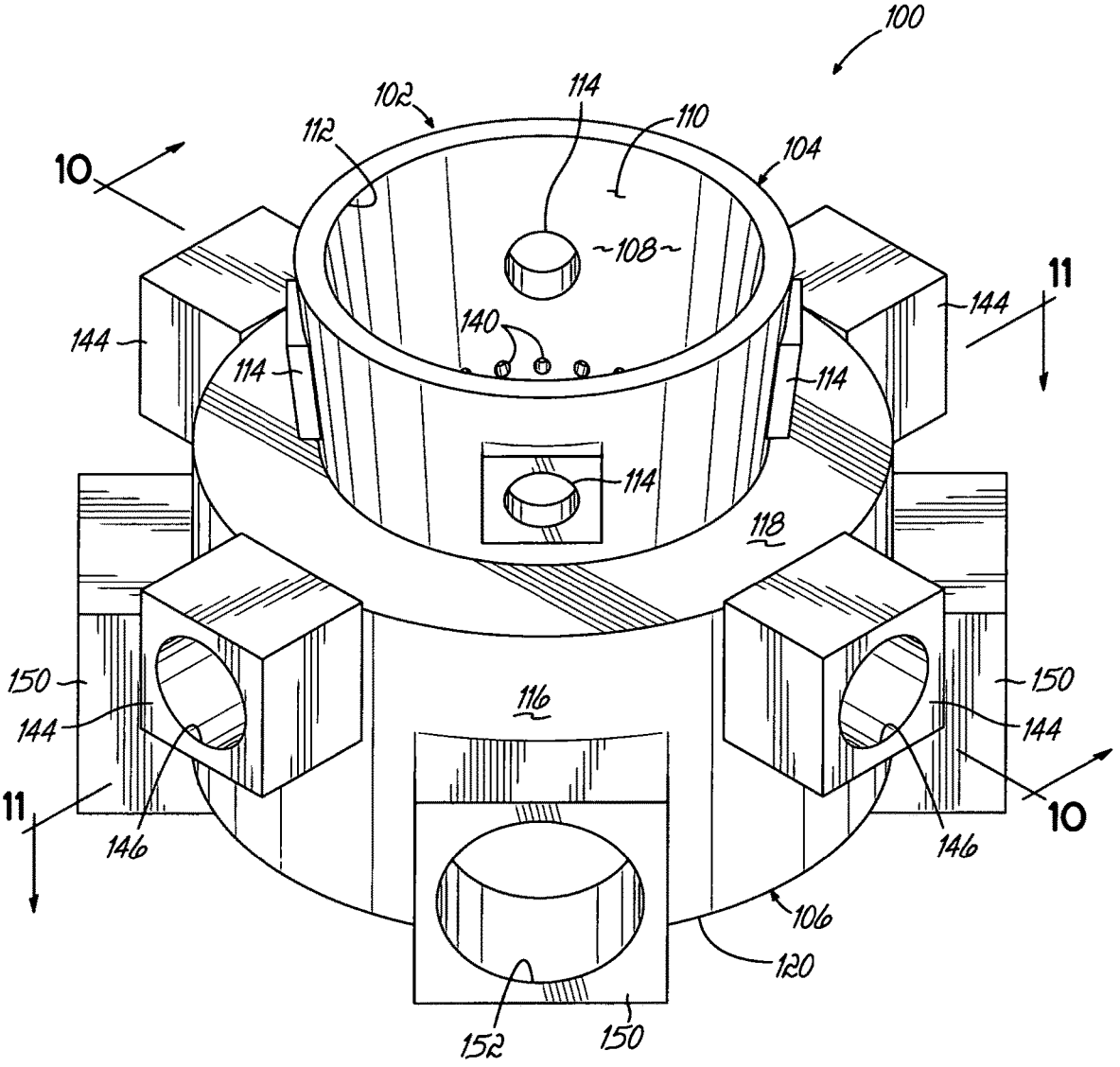
FIG. 9 is a perspective view of a centerbodiless flow-through RDC in accordance with another aspect of the invention.
Figure 10:
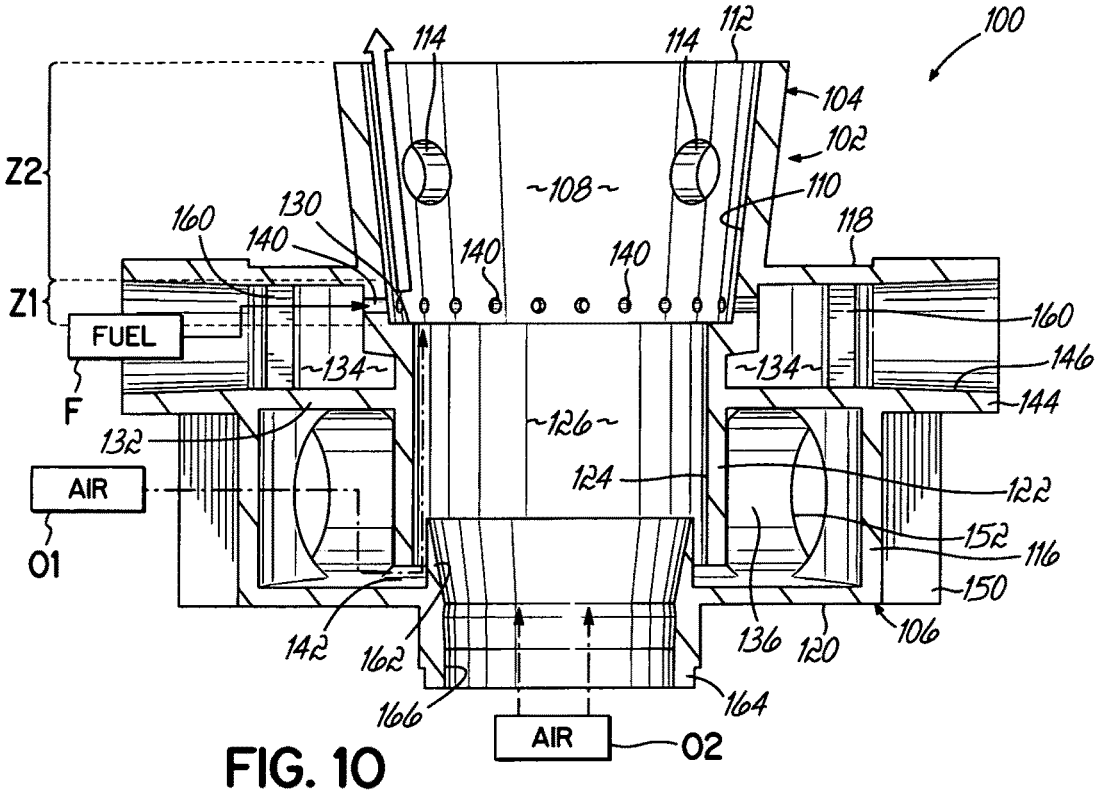
FIG. 10 is a cross sectional view of the RDC of FIG. 9, taken along section line 10-10.
Figure 11:
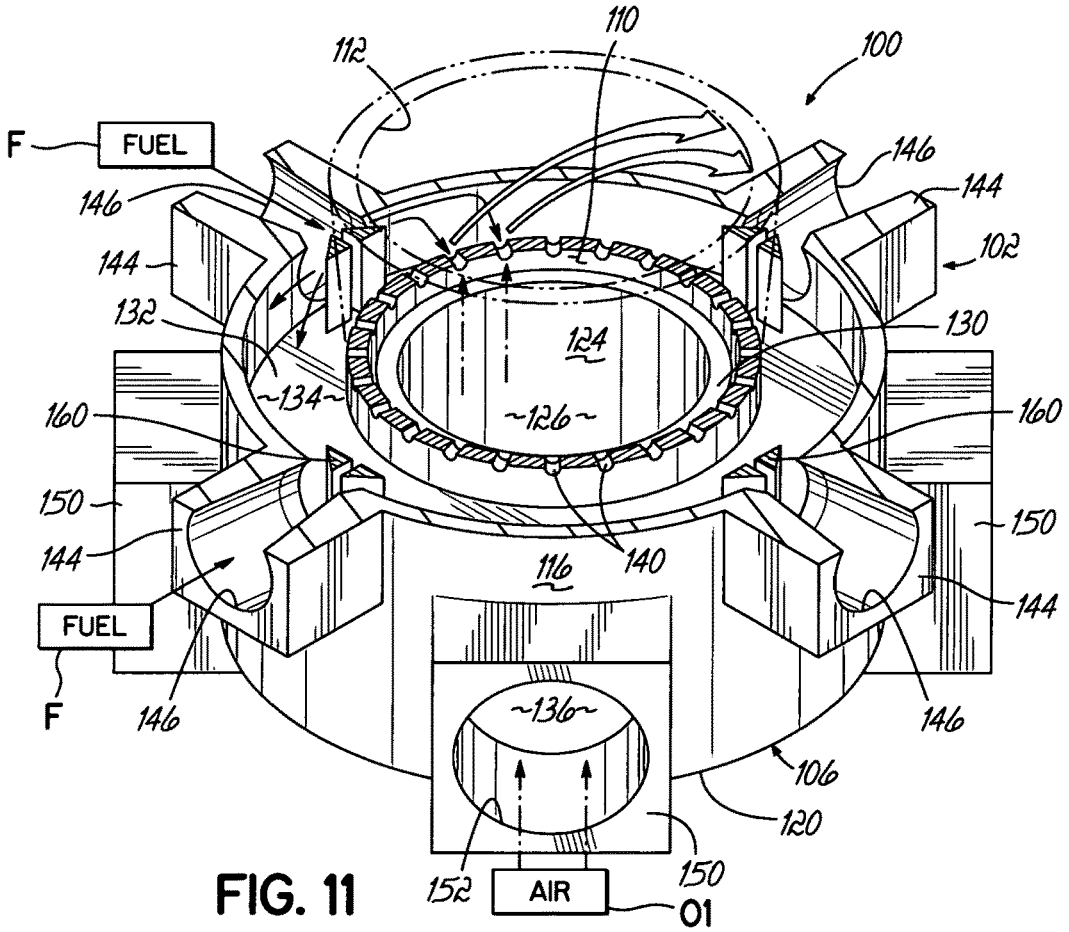
FIG. 11 is a cross sectional view of the RDC of FIG. 9, taken along section line 11-11.

Referring now to FIGS. 9-11, an exemplary RDC 100 is shown in accordance with another aspect of the invention. As discussed in greater detail below, the RDC 100 may not be limited by the confines of having a detonation within an annulus, thereby providing lower heat loss and thus a stronger propagating wave such that the detonation wave may sustain and not fail. The RDC 100 may also have beneficial boundary layer effects, since there is only wall to generate a boundary layer capable of disturbing the detonation front. The RDC 100 may also allow the products to expand significantly in all three axes, in contrast to an annular RDC 100, where product expansion is essentially two-dimensional (if the annulus width is relatively small, as in most cases). This highly three-dimensional products expansion of a hollow RDC 100 would enable faster expulsion of products therefrom, which may result in reduced wasteful pre-burning of the fresh mixtures upstream of the detonation wave by the unexited products of the prior lap. This may lead to higher efficiency by allowing the rotating detonation wave to generally only consume purely fresh reactants, since pre-burnt reactants tend to reduce efficiency. The RDC 100 may be suitable for use as pressure gain afterburners, augmenters, and as part of can-annular systems for combustors, among various other applications. The features of the RDC 100 are set forth in further detail below to clarify each of these functional advantages and other benefits provided in this disclosure.

The illustrated RDC 100 includes a combustor body 102 defined by a concentric outer frustoconical shell 104 and hollow base 106 integrally formed together as a unitary piece. A frustoconical combustion chamber 108 is provided within the outer frustoconical shell 104 such that the outer frustoconical shell 104 defines an outer surface 110 of the combustion chamber 108 which is angled or tapered radially outwardly toward an exhaust opening 112 of the combustion chamber 108. In the embodiment shown, a plurality of measurement ports 114 extend radially through the outer frustoconical shell 104 for allowing measurement devices (not shown) to access the combustion chamber 108 to monitor activities therein. In another embodiment, the ports 114 may be used for an igniter. Alternatively, the measurement ports 114 may be eliminated.

As shown, the outer frustoconical shell 104 extends axially from the hollow base 106 and terminates at or near the exhaust opening 112 of the combustion chamber 108. In the embodiment shown, the outer frustoconical shell 104 and hollow base 106 are integrally formed together as a unitary piece. Alternatively, the outer frustoconical shell 104 and hollow base 106 may be separately formed as independent pieces and coupled together after formation.

The hollow base 106 includes an outer cylindrical wall 116, an annular upper wall 118, an annular lower wall 120, and an inner cylindrical wall 122. The inner cylindrical wall 122 at least partially defines an outer surface 124 of a cylindrical passageway 126 which is in fluid communication with the combustion chamber 108. In the embodiment shown, an annular backward facing step 130 is provided at or near the interface between the passageway 126 and the combustion chamber 108 and, more particularly, between the outer surfaces 124, 110 thereof, the purpose of which is discussed in greater below. By "backward facing," it is meant that the step 130 extends radially outwardly from the point of view of an object or fluid traveling from the passageway 126 into the combustion chamber 108.

As shown, an annular intermediate wall 132 extends between the outer and inner cylindrical walls 116, 122 to define an upper annular fuel plenum 134 and a lower annular oxidizer plenum 136. The fuel plenum 134 is in fluid communication with the combustion chamber 108 via a plurality of fuel inlet channels 140 extending radially through a lower portion of the outer frustoconical shell 104 for radially directing a fuel F such as hydrogen or ethylene from the fuel plenum 134 into the combustion chamber 108, and the oxidizer plenum 136 is in fluid communication with the passageway 126 via an oxidizer inlet annulus 142 for axially directing an oxidizer O1 such as air from the oxidizer plenum 136 into the passageway 126 along the outer surface 124 thereof. In this regard, a plurality of radial fuel ports 144 are positioned circumferentially about the outer cylindrical wall 116 and define fuel plenum inlets 146 for supplying fuel F to the fuel plenum 134 from a fuel source (not shown), and a plurality of radial oxidizer ports 150 are positioned circumferentially about the outer cylindrical wall 116 and define oxidizer plenum inlets 152 for supplying oxidizer O1 to the oxidizer plenum 136 from an oxidizer source (not shown). For example, various hoses or conduits (not shown) may fluidically couple the fuel and oxidizer ports 144, 150 to the respective sources. In the embodiment shown, four radial fuel ports 144 and four radial oxidizer ports 150 are arranged about the outer cylindrical wall 116 at equal intervals, with the radial fuel ports 144 axially above and circumferentially offset equidistantly from the radial oxidizer ports 150. However, any suitable number and arrangement of radial fuel and/or oxidizer ports 144, 150 may be used. In one embodiment, the supplied fuel F and/or oxidizer O may be configured to be driven/pumped from the respective sources. In the embodiment shown, pairs of triangular inlet baffles 160 are positioned within the fuel plenum 134 along the axis of each of the fuel plenum inlets 146 for evenly distributing fuel received therefrom throughout the fuel plenum 134.

As shown, the oxidizer inlet annulus 142 is at least partially defined by a wall 162 of an axial oxidizer port 164 concentric with the passageway 126 and extending at least partially therein to constrict flow of oxidizer O1 as it enters the passageway 126 along the outer surface 124 thereof. The axial oxidizer port 164 also defines an oxidizer inlet channel 166 for axially supplying an oxidizer O2 such as air into the passageway 126 within the center thereof from the oxidizer source, such as via a hose or conduit (not shown). The oxidizer O2 supplied by the axial oxidizer port 164 may be configured to be driven/pumped and/or entrained, as discussed in greater detail below.

The illustrated RDC 100 is centerbodiless. More particularly, the combustion chamber 108 of the RDC 100 lacks the inner cylindrical body 20 or any other central blockage of conventional RDCs 10. The illustrated RDC 100 also has a centerbodiless or unobstructed oxidizer inlet channel 166, such that the RDC 100 may be considered to have a flow-through design.

During operation, fuel F such as hydrogen or ethylene enters the combustion chamber 108 radially through the plurality of fuel inlet channels 140, while an oxidizer O1, O2 such as air enters the combustion chamber 108 axially through the oxidizer inlet annulus 142 and oxidizer inlet channel 166. The fuel F and oxidizer O1 mix together in a mixing zone Z1 at or near the fuel inlet channels 140 prior to being ignited or detonated in a detonation zone Z2 downstream of the fuel inlet channels 140. A predetonator may be used to initiate the ignition. The oxidizer O2 supplied from the oxidizer inlet channel 166 may be entrained through the center of the combustion chamber 108 by driving/pumping the oxidizer O1 supplied from the oxidizer inlet annulus 142, and/or the oxidizer O2 supplied from the oxidizer inlet channel 166 may be driven/pumped completely through the center of the combustion chamber 108. In this manner, the oxidizer O2 supplied from the oxidizer inlet channel 166 may replicate the inner cylindrical body 20 of conventional RDCs 10 by forcing the detonation wave to conform to the curvature of the outer surface 110 of the combustion chamber 108 and thereby rotate. The angled outer surface 110 of the combustion chamber 108 and/or the step 130 may aid in total (or "stagnation") pressure gain for encouraging the generation and propagation of continuous rotating detonation waves at or near the outer surface 110 of the combustion chamber 108. The exhaust then proceeds out the exhaust opening 112 as fresh oxidizer O1, O2 and fuel F enter the mixing zone Z1.

Figure 12:
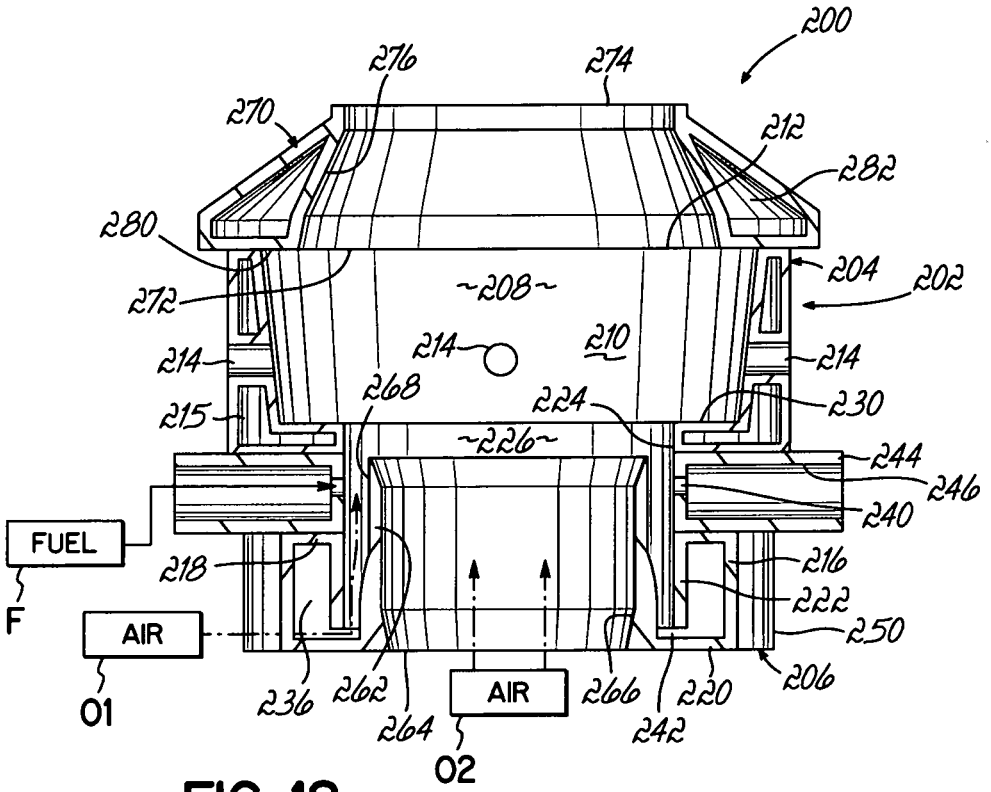
FIG. 12 is a cross sectional view of an alternative centerbodiless flow-through RDC having a backward facing step at the transition into the combustion chamber.

Referring now to FIG. 12, an alternative RDC 200 includes a combustor body 202 defined by a concentric outer cylindrical shell 204 and hollow base 206 integrally formed together as a unitary piece. A frustoconical combustion chamber 208 is provided within the outer cylindrical shell 204 such that the outer cylindrical shell 204 defines an outer surface 210 of the combustion chamber 208 which is angled or tapered radially outwardly toward an exhaust opening 212 of the combustion chamber 208. In the embodiment shown, a plurality of measurement ports 214 extend radially through the outer cylindrical shell 204 for allowing measurement devices (not shown) to access the combustion chamber 208 to monitor activities therein. Alternatively, the measurement ports 214 may be eliminated. The illustrated outer cylindrical shell 204 also includes at least one annular cavity 215 which may receive a fluid, such as water, for cooling purposes.

As shown, the outer cylindrical shell 204 extends axially from the hollow base 206 and terminates at or near the exhaust opening 212 of the combustion chamber 208. In the embodiment shown, the outer cylindrical shell 204 and hollow base 206 are integrally formed together as a unitary piece. Alternatively, the outer cylindrical shell 204 and hollow base 206 may be separately formed as independent pieces and coupled together after formation.

The hollow base 206 includes an outer cylindrical wall 216, an annular upper wall 218, an annular lower wall 220, and an inner cylindrical wall 222. The inner cylindrical wall 222 at least partially defines an outer surface 224 of a cylindrical passageway 226 which is in fluid communication with the combustion chamber 208. In the embodiment shown, a backward facing step 230 is provided at or near the interface between the passageway 226 and the combustion chamber 208 and, more particularly, between the outer surfaces thereof 224, 210.

As shown, the walls 216, 218, 220, 222 of the base 206 define an annular oxidizer plenum 236 in fluid communication with the passageway 226 via an oxidizer inlet annulus 242 for axially directing an oxidizer O1 such as air from the oxidizer plenum 236 into the passageway 226 along the outer surface 224 thereof. In this regard, a plurality of radial oxidizer ports 250 are positioned circumferentially about the outer cylindrical wall 216 and define oxidizer plenum inlets (not shown) for supplying oxidizer O1 to the oxidizer plenum 236 from an oxidizer source (not shown). A plurality of radial fuel ports 244 extend through the combustor body 202 between the oxidizer plenum 236 and combustion chamber 208, and define fuel inlets 246 in fluid communication with the passageway 226 via fuel inlet channels 240 for radially directing fuel F to the passageway 226 from a fuel source (not shown). For example, various hoses or conduits (not shown) may fluidically couple the fuel and oxidizer ports 244, 250 to the respective sources. In one embodiment, the supplied fuel F and/or oxidizer O1 may be configured to be driven/pumped from the respective sources.

As shown, the oxidizer inlet annulus 242 is at least partially defined by a wall 262 of an axial oxidizer port 264 concentric with the passageway 226 and extending at least partially therein to constrict flow of oxidizer O1 as it enters the passageway 226 along the outer surface 224 thereof. The axial oxidizer port 264 also defines an oxidizer inlet channel 266 for axially supplying an oxidizer O2 such as air into the passageway 226 within the center thereof from the oxidizer source, such as via a hose or conduit (not shown). The oxidizer O2 supplied by the axial oxidizer port 264 may be configured to be driven/pumped and/or entrained, in a manner and for reasons similar to those discussed above.

In the embodiment shown, the fuel inlet channels 240 are positioned upstream of the combustion chamber 208. More particularly, the fuel inlet channels 240 extend into the passageway 226. In addition, the wall 262 of the axial oxidizer port 264 extends beyond one or more of the fuel inlet channels 240, thereby at least partially obstructing flow of fuel F therefrom in order to direct the mixture of fuel F and oxidizer O1 axially. The wall 262 of the axial oxidizer port 264 includes a recessed outer portion 268 to allow oxidizer flow to expand at or near the fuel inlet channels 240 in order to provide improved mixing of the fuel F and oxidizer O1. In one embodiment, the RDC 200 may be large air-breathing.

Similar to the previous embodiment, the angled outer surface 210 of the combustion chamber 208 and/or the step 230 may aid in total pressure gain for encouraging the generation and propagation of continuous rotating detonation waves at or near the outer surface 210 of the combustion chamber 208.

The illustrated RDC 200 includes a converging nozzle 270 coupled to the combustor body 202 over the exhaust opening 212. The converging nozzle 270 includes a nozzle inlet 272, a nozzle outlet 274, and at least one converging surface 276, which is angled or tapered radially inwardly from the nozzle inlet 272 toward the nozzle outlet 274. In the embodiment shown, the cross sectional dimension of the nozzle inlet 272 is smaller than that of the exhaust opening 212, such that the nozzle 270 forms a forward facing step 280. The step 280 and/or converging surface 276 of the nozzle 270 may obstruct the detonation waves to generate longitudinal pulsed detonations in a manner similar to that described above. In one embodiment, the convergence angle of the converging surface 276 may be increased to improve choking of the exhaust opening 212 and thereby produce backpressure. In addition or alternatively, the step 280 and/or converging surface 276 may assist in natural reflection of transverse waves, further stabilizing detonation. In this regard, the nozzle 270 may promote steady detonation for fuel and unenriched air. The step 280 may be used to cause flow separation as the reactants pass across it, thereby causing accumulation of fresh reactants in the combustion chamber 208 to produce rotating detonations in the hollow RDC 200. The illustrated nozzle 270 also includes at least one annular cavity 282 which may receive a fluid, such as water, for cooling purposes.

In one embodiment, the dimensions of the illustrated RDC 200 may be as set forth in Table 2.

TABLE 2

Exemplary RDC Dimensions

| Combustor Geometric Parameters | Dimension |
|---|---|
| Nozzle height | 4.5 cm |
| Nozzle inlet diameter | 12.8 cm |
| Nozzle outlet diameter | 10 cm |
| Shell height | 6.5 cm |
| Exhaust opening diameter | 15 cm |
| Combustion chamber diameter (lowermost) | 14 cm |
| Passageway diameter | 10 cm |
| Height of step | 1 cm |
| Distance between fuel inlet channels and top of fuel section | 5 mm |

However, it will be appreciated that other dimensions may be used. For example, the dimensions of the RDC 200 may be scalable relative to these exemplary dimensions.

Figure 13:
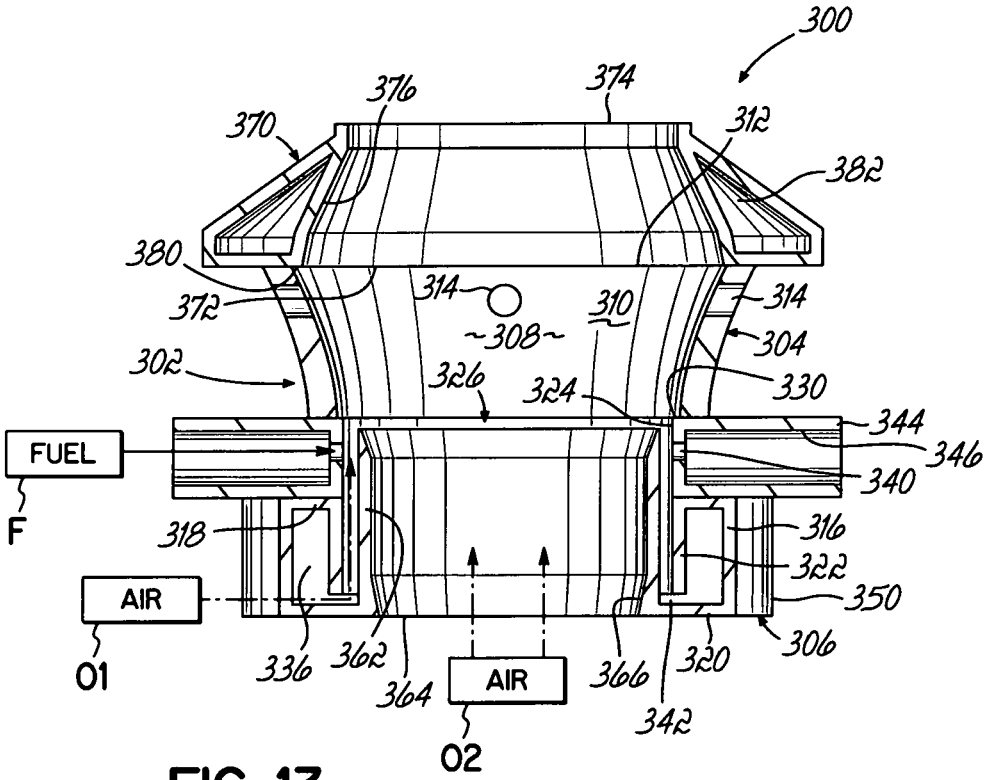
FIG. 13 is a cross sectional view of an alternative centerbodiless flow-through RDC having a smooth transition into the combustion chamber.

Referring now to FIG. 13, an alternative RDC 300 includes a combustor body 302 defined by a concentric outer flared frustoconical shell 304 and hollow base 306 integrally formed together as a unitary piece. A flared frustoconical combustion chamber 308 is provided within the outer flared frustoconical shell 304 such that the outer flared frustoconical shell 304 defines an outer surface 310 of the combustion chamber 308 which is tapered radially outwardly in a smoothly curved manner toward an exhaust opening 312 of the combustion chamber 308. In the embodiment shown, a plurality of measurement ports 314 extend radially through the outer flared frustoconical shell 304 for allowing measurement devices (not shown) to access the combustion chamber 308 to monitor activities therein. Alternatively, the measurement ports 314 may be eliminated.

As shown, the outer flared frustoconical shell 304 extends axially from the hollow base 306 and terminates at or near the exhaust opening 312 of the combustion chamber 308. In the embodiment shown, the outer flared frustoconical shell 304 and hollow base 306 are integrally formed together as a unitary piece. Alternatively, the outer flared frustoconical shell 304 and hollow base 306 may be separately formed as independent pieces and coupled together after formation.

The hollow base 306 includes an outer cylindrical wall 316, an annular upper wall 318, an annular lower wall 320, and an inner cylindrical wall 322. The inner cylindrical wall 322 at least partially defines an outer surface 324 of a cylindrical passageway 326 which is in fluid communication with the combustion chamber 308. In the embodiment shown, a relatively small backward facing step 330 is provided at or near the interface between the passageway 326 and the combustion chamber 308 and, more particularly, between the outer surfaces 324, 310 thereof. The backward facing step 330 is relatively shorter than in the previous embodiments. In one embodiment, the backward facing step 330 may be eliminated to provide a relatively seamless smooth transition between the outer surface 324 of the passageway 326 and the outer surface 310 of the combustion chamber 308.

As shown, the walls 316, 318, 320, 322 of the base 306 define an annular oxidizer plenum 336 in fluid communication with the passageway 326 via an oxidizer inlet annulus 342 for axially directing an oxidizer O1 such as air from the oxidizer plenum 336 into the passageway 326 along the outer surface 324 thereof. In this regard, a plurality of radial oxidizer ports 350 are positioned circumferentially about the outer cylindrical wall 316 and define oxidizer plenum inlets (not shown) for supplying oxidizer O1 to the oxidizer plenum 336 from an oxidizer source (not shown). A plurality of radial fuel ports 344 extend through the combustor body 302 between the oxidizer plenum 336 and combustion chamber 308, and define fuel inlets 346 in fluid communication with the passageway 326 via fuel inlet channels 340 for radially directing fuel F to the passageway 326 from a fuel source (not shown). For example, various hoses or conduits (not shown) may fluidically couple the fuel and oxidizer ports 344, 350 to the respective sources. In one embodiment, the supplied fuel F and/or oxidizer O1 may be configured to be driven/pumped from the respective sources.

As shown, the oxidizer inlet annulus 342 is at least partially defined by a wall 362 of an axial oxidizer port 364 concentric with the passageway 326 and extending at least partially therein to constrict flow of oxidizer O1 as it enters the passageway 326 along the outer surface 324 thereof. The axial oxidizer port 364 also defines an oxidizer inlet channel 366 for axially supplying an oxidizer O2 such as air into the passageway 326 within the center thereof from the oxidizer source, such as via a hose or conduit (not shown). The oxidizer O2 supplied by the axial oxidizer port 364 may be configured to be driven/pumped and/or entrained, in a manner and for reasons similar to those discussed above.

In the embodiment shown, the fuel inlet channels 340 are positioned upstream of the combustion chamber 308. More particularly, the fuel inlet channels 340 extend into the passageway 326. In addition, the wall 362 of the axial oxidizer port 364 extends beyond one or more of the fuel inlet channels 340, thereby at least partially obstructing flow of fuel F therefrom in order to direct the mixture of fuel F and oxidizer O1 axially. In one embodiment, the RDC 300 may be large air-breathing.

In this embodiment, the curvedly tapered outer surface 310 of the combustion chamber 308 may aid in total pressure gain for encouraging the generation and propagation of continuous rotating detonation waves at or near the outer surface 310 of the combustion chamber 308.

The illustrated RDC 300 includes a converging nozzle 370 coupled to the combustor body 302 over the exhaust opening 312. The converging nozzle 370 includes a nozzle inlet 372, a nozzle outlet 374, and at least one converging surface 376, which is angled or tapered radially inwardly from the nozzle inlet 372 toward the nozzle outlet 374. In the embodiment shown, the cross sectional dimension of the nozzle inlet 372 is smaller than that of the exhaust opening 312, such that the nozzle 370 forms a forward facing step 380. The step 380 and/or converging surface 376 of the nozzle 370 may obstruct the detonation waves to generate longitudinal pulsed detonations in a manner similar to that described above. In addition or alternatively, the step 380 and/or converging surface 376 may assist in natural reflection of transverse waves, further stabilizing detonation. In this regard, the nozzle 370 may promote steady detonation for fuel and unenriched air. In one embodiment, the convergence angle of the converging surface 376 may be increased to improve choking of the exhaust opening 312 and thereby produce backpressure. In addition or alternatively, the step 380 and/or converging surface 376 may assist in natural reflection of transverse waves, further stabilizing detonation. In this regard, the nozzle 370 may promote steady detonation for fuel and unenriched air. The step 380 may be used to cause flow separation as the reactants pass across it, thereby causing accumulation of fresh reactants in the combustion chamber 308 to produce rotating detonations in the hollow RDC 300. The illustrated nozzle 370 also includes at least one annular cavity 382 which may receive a fluid, such as water, for cooling purposes.

In one embodiment, the dimensions of the illustrated RDC 300 may be as set forth in Table 3.

TABLE 3

Exemplary RDC Dimensions

| Combustor Geometric Parameters | Dimension |
|---|---|
| Nozzle height | 4.5 cm |
| Nozzle inlet diameter | 12.8 cm |
| Nozzle outlet diameter | 10 cm |
| Shell height | 4.5 cm |
| Exhaust opening diameter | 12.8 cm |
| Combustion chamber diameter (lowermost) | 10 cm |

However, it will be appreciated that other dimensions may be used. For example, the dimensions of the RDC 300 may be scalable relative to these exemplary dimensions.

Figure 14:
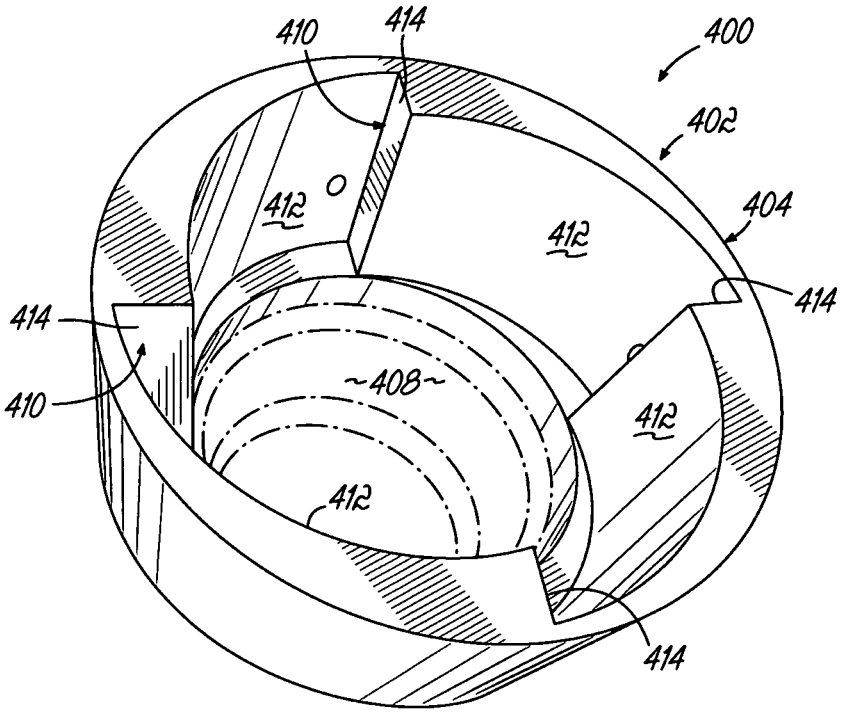
FIG. 14 is a perspective view of an alternative centerbodiless flow-through RDC having a plurality of ramps arranged along the outer periphery of the combustion chamber.

Referring now to FIG. 14, an alternative RDC 400 includes a combustor body 402 defined at least in part by an outer frustoconical shell 404 having a combustion chamber 408 provided therein. A plurality of ramps 410 are circumferentially arranged along the outer periphery of the combustion chamber 408 for controlling the direction of detonation wave travel therein. In this regard, it has been observed that when multiple detonation waves are present in a conventional RDC 10, one or more of the waves may reverse direction, thereby causing wave collisions which result in unstable operation. The illustrated ramps 410 may ensure that the detonation waves propagate in a predetermined intended direction. To this end, each ramp 410 includes a curved ramping surface 412 configured to direct detonation wave travel in a first direction, and a flat obstructing surface 414 configured to inhibit detonation wave travel in a second direction opposite the first direction. In the embodiment shown, the ramping surfaces 412 are configured to direct detonation wave travel in a counterclockwise direction, and the obstructing surfaces 414 are configured to prevent detonation wave travel in a clockwise direction. More particularly, each ramping surface 412 curves radially inwardly in a counterclockwise direction, thereby allowing detonation waves to travel in a counterclockwise direction, and each obstructing surface 414 opposes a clockwise direction, thereby preventing detonation waves from traveling in a clockwise direction. Alternatively, each ramping surface 412 may curve radially inwardly in a clockwise direction, and each obstructing surface 414 may oppose a counterclockwise direction, in order to achieve the opposite effects for directing detonation wave travel in a clockwise direction.

Four ramps 410 are shown arranged along the outer periphery of the combustion chamber 408 of the illustrated RDC 400. However, any suitable number of ramps 410 may be used as may be desired. In the embodiment shown, the ramps 410 are integrally formed with the combustor body 402 as a unitary piece. Alternatively, the ramps 410 may be provided on a separately formed sleeve or insert (not shown) which may be positioned within the combustor body of an RDC. For example, such an insert may be positioned within the combustion chamber 208 of the RDC 200 shown in FIG. 12.

Figure 15:
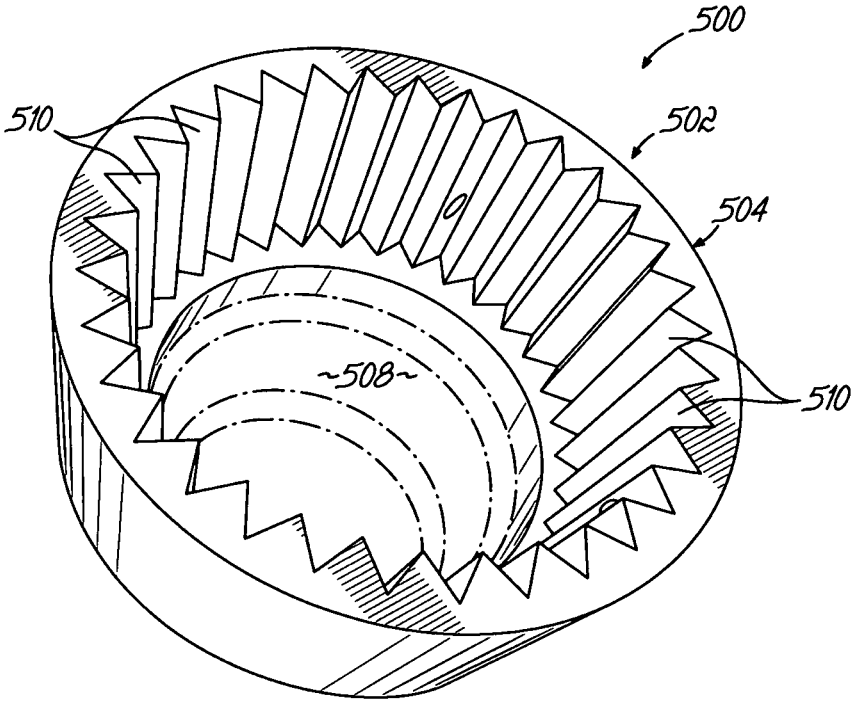
FIG. 15 is a perspective view of an alternative centerbodiless flow-through RDC having a plurality of sawteeth arranged along the outer periphery of the combustion chamber.

Referring now to FIG. 15, an alternative RDC 500 includes a combustor body 502 defined at least in part by an outer frustoconical shell 504 having a combustion chamber 508 provided therein. A plurality of obstacles in the form of sawteeth 510 are circumferentially and continuously arranged along the outer periphery of the combustion chamber 508 for increasing the range of effectiveness of the RDC 500. In this regard, the sawteeth 510 may be used to obtain, enhance, and/or sustain detonative behavior in the RDC 500 by forming reflected shock waves and/or turbulence. As shown, the sawteeth 510 may define undulations and/or corrugations about the outer periphery of the combustion chamber 508.

In the embodiment shown, the sawteeth 510 are integrally formed with the combustor body 502 as a unitary piece. Alternatively, the sawteeth 510 may be provided on a separately formed sleeve or insert (not shown) which may be positioned within the combustor body of an RDC. For example, such an insert may be positioned within the combustion chamber 208 of the RDC 200 shown in FIG. 12.

Hollow RDCs in accordance with the present invention may be configured with various other design changes, such as for increasing pressure gain and/or mixing efficiency. For example, such design changes may include straight conical expansion, sharp angled throats, parabolic expansion, converging-diverging nozzles, and alterations to the size and shape of fuel and air inlet channels.

Figure 16A:
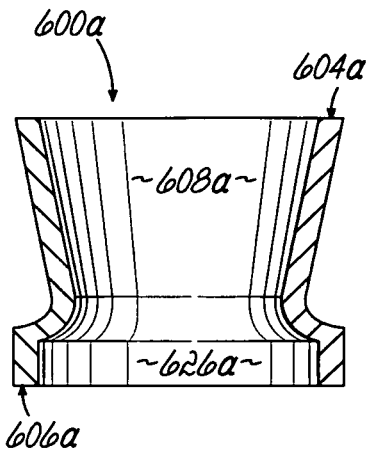
FIGS. 16A-16C are cross sectional views of alternative centerbodiless flow-through RDCs.
Figure 16B:
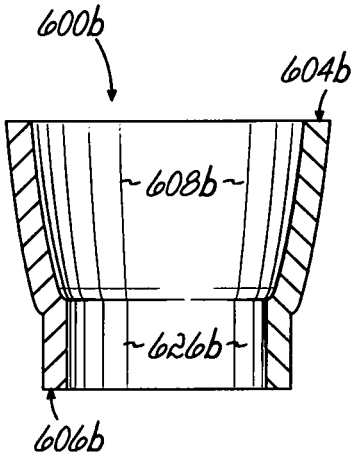
Figure 16C:
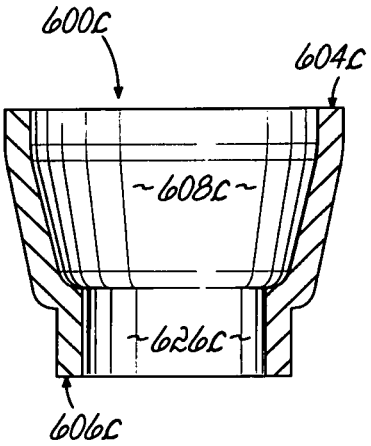

Referring now to FIGS. 16A-16C, various alternative RDCs 600*a*, 600*b*, 600*c* are illustrated in longitudinal cross section with various features not shown for the sake of simplicity. The illustrated RDCs 600*a*, 600*b*, 600*c* include various configurations of the outer shell 604*a*, 604*b*, 604*c*, the hollow base 606*a*, 606*b*, 606*c* and the transition between the passageway 626*a*, 626*b*, 626*c* and combustion chamber 608*a*, 608*b*, 608*c*. For example, FIG. 16A shows a smooth converging diverging throat transitioning into a straight conical combustion chamber 608*a*. Such a configuration may create a low-separation combustor with still some flare for thrust production. FIG. 16B shows a cross section with a semi-parabola centered at an edge, creating a quasi-parabolic step. At higher temperatures and pressures or with higher reactivity mixtures, this configuration may result in a lower drag reflection of the detonation wave. FIG. 16C shows a backward facing step with a circular transition to a conical section, followed by a straight section. Such a configuration may be readily incorporated into a closed system. These alternative RDCs 600*a*, 600*b*, 600*c* may provide varying degrees of thrust production or pressure gain and separation of flow, leading to successful pressure gain in varying mixtures at various initial temperatures and pressures.

Figure 17A:
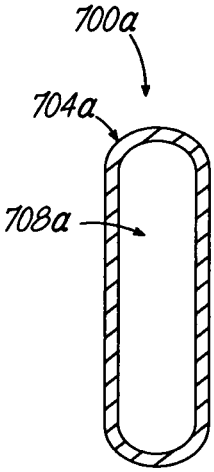
FIGS. 17A-17C are cross sectional views of alternative centerbodiless flow-through RDCs.
Figure 17B:
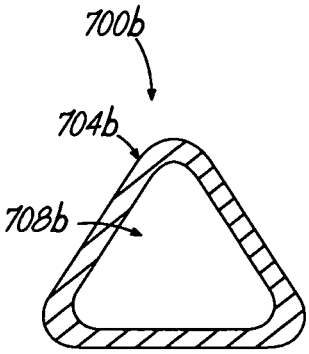
Figure 17C:
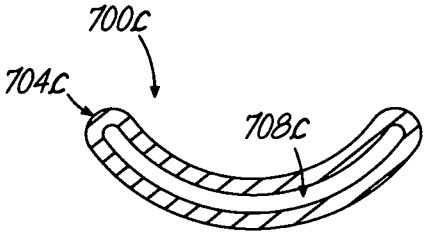

Referring now to FIGS. 17A-17C, various alternative RDCs 700*a*, 700*b*, 700*c* are illustrated in radial cross section with various features not shown for the sake of simplicity. Each of the RDCs 700*a*, 700*b*, 700*c* includes an outer shell 704*a*, 704*b*, 704*c* and combustion chamber 708*a*, 708*b*, 708*c* having non-circular cross sectional shapes, such as to accommodate the geometry of the vehicles to which they are attached. For example, the RDC 700*a* of FIG. 17A is ovoid in cross section, the RDC 700*b* of FIG. 17B is triangular in cross section, and the RDC 700*c* of FIG. 17C is annular sector-shaped in cross section. These RDCs 700*a*, 700*b*, 700*c* may be configured to fit in ovoid, triangular, and annular sector shaped spaces, respectively, of the vehicles to which they are attached. It will be appreciated that any other suitable cross sectional shape may be used. For example, an RDC may have any suitable polygonal cross sectional shape for accommodating the geometry of the vehicle to which it is attached, such as a trapezoidal cross sectional shape.

Figure 18:
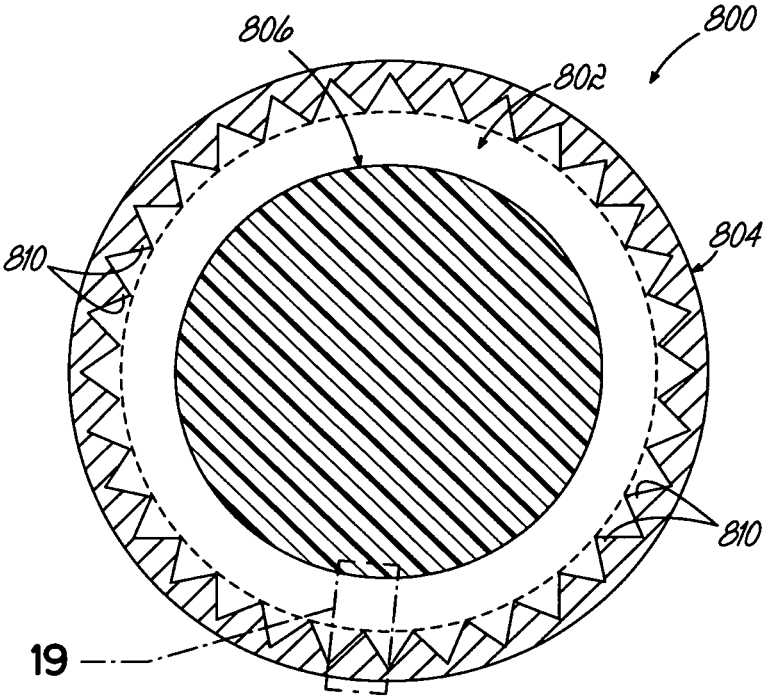
FIG. 18 is a cross sectional view of an annular RDC having a plurality of obstacles arranged along the outer periphery of the combustion chamber.

Referring now to FIG. 18, an exemplary RDC 800 is shown in accordance with another aspect of the invention. As discussed in greater detail below, the RDC 800 may produce shock-reflections and turbulence-generation that may produce and sustain rotating detonation waves in otherwise inhospitable conditions of geometries, flow rates, and/or reactants, thereby enhance performance, and may be suitable for use as pressure gain afterburners, augmenters, and as part of can-annular systems for combustors, among various other applications. The features of the RDC 800 are set forth in further detail below to clarify each of these functional advantages and other benefits provided in this disclosure.

The illustrated RDC 800 includes an annular combustion chamber 802 defined by an outer cylindrical shell 804 and a concentric inner cylindrical body 806.

As shown, the RDC 800 includes a plurality of obstacles in the form of sawteeth 810 circumferentially and continuously arranged along the outer periphery of the combustion chamber 802 for increasing the range of effectiveness of the RDC 800. In this regard, the sawteeth 810 may be used to obtain, enhance, and/or sustain detonative behavior in the RDC 800 by forming reflected shock waves and/or turbulence. As shown, the sawteeth 810 may define undulations and/or corrugations about the outer periphery of the combustion chamber 802.

Figure 19A:
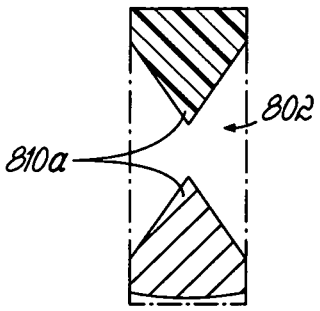
FIGS. 19A-19D are partial cross sectional views of the annular RDC of FIG. 18 showing alternative configurations and locations of the obstacles.
Figure 19B:
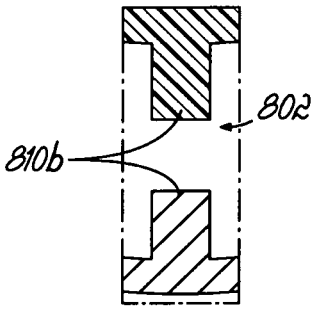
Figure 19C:
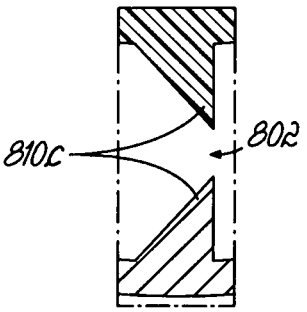

As shown in FIGS. 19A-19C, various other obstacles 810*a*, 810*b*, 810*c* may be of any suitable cross-sectional shape, such as a symmetric triangle (FIG. 19A), a rectangle (FIG. 19B), or an asymmetric triangle (FIG. 19C), and may be arranged on either or both of the inner and outer periphery of the combustion chamber 802. Any other suitable cross-sectional shape may be used to achieve the same or similar effect. For example, an elliptical cross-sectional shape may be used to promote the same or similar effect.

While the obstacles 810 are shown arranged circumferentially about the outer periphery of the combustion chamber 802 (e.g., on the outer shell 804) in FIG. 18, it will be appreciated that the obstacles 810 may additionally or alternatively be arranged circumferentially about the inner periphery of the combustion chamber 802 (e.g., on the inner body 806). The arrangement of obstacles 810 may be continuous or interrupted. In this regard, the distance between the individual obstacles 810 may be varied to promote or weaken the detonation formation and sustenance dynamics. As shown, the pluralities of obstacles 810 may define undulations and/or corrugations about the respective periphery. The obstacles 810 may each be formed as grooves extending along substantially the entire height of the combustion chamber 802. In addition or alternatively, the obstacles 810 may be positioned at select portions of the periphery(ies) of the combustion chamber 802. The obstacles 810 may be integrated into any suitable RDC configuration to promote detonations, such as hollow combustors, annular combustors, rectangular cross-sectional combustors, and/or circular cross-sectional combustors.

Figure 19D:
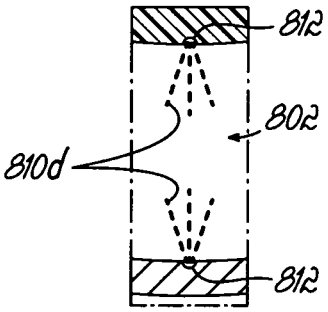

As shown in FIG. 19D, an obstacle in the form of one or more fluidic jets 810*d* sprayed from one or more jet outlets 812 positioned along the inner and/or outer periphery(ies) of the combustion chamber 802 may be used to replicate the effect of a solid object obstacle. In this regard, the high speed jets 810*d* in high speed cross-streams may act as a virtual solid object. The fluidic jets may be immune to the possibility of melting in the high temperature environment of the combustion chamber 802 which may otherwise be capable of melting solid object obstacles 810*a*, 810*b*, 810*c*. Thus, the two primary elements of this method (reflected acoustic/shock waves and turbulence formation) can be used to produce detonations in combustors by using fluidic injection at the appropriate locations inside the combustion chamber 802. This high speed input fluid could be either the fuel F or oxidizer O, for example, and would reduce the overall mass of the RDC 800 as compared to the aforementioned solid object obstacles 810*a*, 810*b*, 810*c*. Furthermore, such fluidic obstacles 810*d* may assist in controlling the combustion process within the combustion chamber 802 if sufficiently regulated, and may assist in controlling combustion modes at various operating regimes of the RDC 800 (e.g. low/high altitude, low/high throttling, etc.). It will be appreciated that these processes of producing detonations may be used for producing rotating detonations in RDCs 800 and/or for producing and sustaining longitudinal pulsed detonations (LPD) in RDCs 800. In the latter case, the obstacles 810*a*, 810*b*, 810*c*, 810*d* may be reoriented to be nominally perpendicular to the direction for propagation of the longitudinal pulsed detonations. This may be readily performed actively when using fluid jets 810*d*, such as by actuating the angle of injection of the jet outlets 812.

One aspect of this process is the significant obstruction of the combustion front. During use of an RDC to produce rotating high speed combustion fronts (detonations), there is a moving reactivity gradient. This gradient, or wave, will produce turbulence downstream of it, and will also cause acoustic disturbance upstream of it. Both these properties of a deflagrative combustion wave can be used to cause onset of detonation waves. By using obstacles upstream of this deflagration wave, this turbulence can be triggered to increase in strength causing strong vortices which have in them not just the burnt gas but also "pockets" of unburnt fresh reactants. These "cold fresh pockets" of reactants will then explode randomly when exposed to the surrounding conditions of high temperature, thereby causing detonations. Additionally, usage of obstacles upstream of such deflagration waves can also produce "acoustic coalescence" which in turn produces shock waves, thereby once again triggering detonations. Thus, both these effect (pockets of reactants and acoustic coalescence) are produced by having an obstacle to obstruct a moving combustion front, which causes the onset of a detonation event. This event can sustain indefinitely assuming the other conditions (geometry, flow rates, etc.) are maintained.

Another aspect of this process is induced reflected shocks. A shock wave is a pressure event moving at supersonic speeds with an almost instantaneous change in pressure, temperature and density downstream of the event. By impeding the now-formed detonation wave, additional reflected shocks form and aid in sustaining the detonation front even when the geometry is smaller than the required detonation cell width size. The mechanisms by which a shockwave supports detonations are twofold: First, shock waves, as outlined by the Zel'dovich-von Neumann-Döring model, induce reactants which allow higher heat extraction by the resulting exothermic reaction. Secondly, shock waves induce mixing when interacting with a steady stream of fluid, which in combustors are in great quantity due to common reactants injection designs. This mixing process is referred to as the Richtmeyer-Meshkov Instability and is often employed in SCRAM jet propulsion.

Another aspect of this process is induced downstream turbulence. For efficient combustion, the fuel and oxidizer are to be uniformly and thoroughly mixed. This process is made up of both turbulence, aiding in the macro mixing of two or more fluids, and vortex formation defined as vorticity which insinuates microscopic mixing at a molecular level. Previously, combustors used swirler nozzles to initiate these fluidic perturbations. However, by implementing the obstacles to obstruct the flow, a complex swirling apparatus is no longer required, and the subsequent laps (or revolutions) of the newly onset detonation wave will interact with the turbulence it produced in the prior laps, thereby once again helping in sustenance.

While the various geometries and configurations disclosed herein have been described and illustrated as being incorporated into hollow and/or annular RDCs, it will be appreciated that the same may be incorporated into other RDCs, such as disk shaped RDCs.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The present invention in its broader aspects is therefore not limited to the specific details and illustrative examples shown and described. Accordingly, departures may be made from such details without departing from the scope of the general inventive concept.

What is claimed is:

1. A rotating detonation combustor comprising:

a combustor body including an outer shell at least partially defining a detonation combustion chamber, the detonation combustion chamber having a longitudinal axis and an exhaust opening concentric with the longitudinal axis; and a base coupled to the detonation combustion chamber, the base defining a passageway concentric with the longitudinal axis of and in fluid communication with the detonation combustion chamber, the base including an axial port concentric with the longitudinal axis and in fluid communication with the passageway, wherein the axial port is configured such that a first fluid enters through the axial port in a direction along the longitudinal axis and through the passageway along the longitudinal axis, the base further including an inlet annulus for axially directing a second fluid into the detonation combustion chamber, wherein the detonation combustion chamber further including a plurality of inlet channels for radially directing a third fluid into the detonation combustion chamber so as to mix with the second fluid in the detonation combustion chamber and thereby produce a detonation wave therein, and wherein the detonation combustion chamber is free of any inner body.

2. The rotating detonation combustor of claim 1, wherein a backward facing step is provided between an outer surface of the passageway and an outer surface of the detonation combustion chamber.

3. The rotating detonation combustor of claim 1, wherein the detonation combustion chamber is frustoconical and expands radially outwardly toward the exhaust opening.

4. The rotating detonation combustor of claim 3, wherein the detonation combustion chamber is flared.

5. The rotating detonation combustor of claim 1, further comprising a nozzle coupled to the combustor body at or near the exhaust opening to choke the exhaust opening.

6. The rotating detonation combustor of claim 5, wherein the nozzle includes a nozzle inlet, a nozzle outlet, and a converging surface between the nozzle inlet and the nozzle outlet.

7. The rotating detonation combustor of claim 5, wherein the nozzle at least partially defines a forward facing step between an outer surface of the detonation combustion chamber and the converging surface of the nozzle.

8. The rotating detonation combustor of claim 1, further comprising at least one ramping surface positioned along an outer periphery of the detonation combustion chamber.

9. The rotating detonation combustor of claim 1, further comprising at least one obstruction positioned along an outer periphery of the detonation combustion chamber.

* * * * *